United States Patent [19]

Jullien

[11] 4,312,511

[45] Jan. 26, 1982

[54] ELECTRONIC BINGO SYSTEM

[75] Inventor: Graham A. Jullien, Windsor, Canada

[73] Assignee: James J. Ogilvy, Ontario, Canada

[21] Appl. No.: 18,504

[22] Filed: Mar. 8, 1979

[30] Foreign Application Priority Data

Apr. 7, 1978 [CA] Canada ..... 300670

[51] Int. Cl.[3] ..... A63F 3/06

[52] U.S. Cl. ..... 273/237; 273/269; 273/138 A; 340/323 R; 340/717; 340/752

[58] Field of Search ..... 273/138 R, 138 A, 139, 273/237, 238, 144 R, 144 A, 144 B; 340/323 R, 700, 710, 717, 752

[56] References Cited

U.S. PATENT DOCUMENTS

| | | | |
|---|---|---|---|
| 3,300,217 | 1/1967 | Franklin | 273/238 |
| 3,653,026 | 3/1972 | Hurley | 237/138 A X |
| 4,027,301 | 5/1977 | Mayer | 340/163 X |
| 4,218,063 | 8/1980 | Cooper et al. | 273/237 |

FOREIGN PATENT DOCUMENTS

| | | | |
|---|---|---|---|
| 1103011 | 2/1968 | United Kingdom | 273/237 |

*Primary Examiner*—William H. Grieb

*Attorney, Agent, or Firm*—Craig and Antonelli

[57] ABSTRACT

An electronic bingo system for generally enhancing the operation and playing value of the game, by providing such features as flashing the last number called, providing an exciting light display upon designation of a winner, etc. The game is comprised of a ball table including a matrix of numbered switches for closure upon interference by a numbered ball, a plurality of control switches, a general display for individually illuminating one or more numbers corresponding to each numbered switch of the matrix of switches, circuitry at the table for causing a digital display to indicate the number of the numbered switch upon the at least temporary closure of one of the numbered switches, and circuitry for illuminating the corresponding number in the general display upon at least temporary closure of a predetermined one of the control switches.

22 Claims, 25 Drawing Figures

I/O BOARD

TIMING DIAGRAM RELATING I/O & LAMP DRIVER BOARD

| B REGISTER ADDRESS | B REGISTER Ø | 1 | 2 | 3 | A REGISTER 4 | 5 | 6 | 7 | A REGISTER ADDRESS |
|---|---|---|---|---|---|---|---|---|---|
| 5Ø | 1 | 2 | 3 | 4 | 5 | 6 | 7 | 8 | 4Ø |
| 51 | 9 | 1Ø | 11 | 12 | 13 | 14 | 15 | | 41 |
| 52 | 16 | 17 | 18 | 19 | 20 | 21 | 22 | 23 | 42 |
| 53 | 24 | 25 | 26 | 27 | 28 | 29 | 3Ø | | 43 |
| 54 | 31 | 32 | 33 | 34 | 35 | 36 | 37 | 38 | 44 |
| 55 | 39 | 40 | 41 | 42 | 43 | 44 | 45 | | 45 |
| 56 | 46 | 47 | 48 | 49 | 50 | 51 | 52 | 53 | 46 |
| 57 | 54 | 55 | 56 | 57 | 58 | 59 | 6Ø | | 47 |
| 58 | 61 | 62 | 63 | 64 | 65 | 66 | 67 | 68 | 48 |
| 59 | 69 | 70 | 71 | 72 | 73 | 74 | 75 | | 49 |
| 5A | 76 | 77 | 78 | 79 | 8Ø | 81 | 82 | 83 | 4A |
| 5B | 84 | 85 | 86 | 87 | 88 | 89 | 9Ø | | 4B |
| 5C | | | | | | | | | 4C |
| 5D | | | | | | | | | 4D |
| 5E | | | | | | | | | 4E |
| 5F | | | | | | | | | 4F |

PATTERN STORAGE

4269 RAM STORAGE OF INDICATOR BOARD POSITIONS

FIG. 10

4040 SCRATCH REGISTER ASSIGNEMENTS

| FIFO ADDRESS | RD2 | | | | RD1 | | | | |
|---|---|---|---|---|---|---|---|---|---|
| 40 | 1 | 2 | 3 | 4 | 5 | 6 | 7 | 8 | |
| 42 | 16 | 17 | 18 | 19 | 20 | 21 | 22 | 23 | |
| 44 | 31 | 32 | 33 | 34 | 35 | 36 | 37 | 38 | |
| 46 | 46 | 47 | 48 | 49 | 50 | 51 | 52 | 53 | BLOCK 1 |
| 48 | 61 | 62 | 63 | 64 | 65 | 66 | 67 | 68 | |
| 4A | 76 | 77 | 78 | 79 | 80 | 81 | 82 | 83 | PATTERN SWITCHES FOR 75 # SYSTEM |
| 4C | | | | | | | | | |
| 4E | | | | | | | | | |

| | | | | | | | | | |
|---|---|---|---|---|---|---|---|---|---|
| 40 | 9 | 10 | 11 | 12 | 13 | 14 | 15 | | |
| 42 | 24 | 25 | 26 | 27 | 28 | 29 | 30 | | |
| 44 | 39 | 40 | 41 | 42 | 43 | 44 | 45 | | |
| 46 | 54 | 55 | 56 | 57 | 58 | 59 | 60 | | BLOCK 2 |
| 48 | 69 | 70 | 71 | 72 | 73 | 74 | 75 | | |
| 4A | 84 | 85 | 86 | 87 | 88 | 89 | 90 | | PATTERN SWITCHES FOR 75 # SYSTEM |
| 4C | ROTATE PATTERN | TEST PATTERN | | CANCEL | SPEED UP TIMER | SLOW DOWN TIMER | START GAME | TEST SYSTEM | CONTROL SWITCHES |
| 4E | | | | | | | | CLOCK SWITCH | |

FIRST IN-FIRST OUT SWITCH MATRIX BUFFER
(4269)

FIG. 12

| | | | | |
|---|---|---|---|---|
| 1 | 2 | 11 | 9 | 7 |
| 3 | 4 | 12 | 10 | 8 |
| 5 | 6 | 25 | 18 | 17 |
| 20 | 22 | 24 | 16 | 15 |
| 19 | 21 | 23 | 14 | 13 |

CONNECTIONS FROM LAMP DRIVER BOARD SWITCH POSITIONS TO PATTERN BOARD

FIG. 13

MAIN ROUTINE FLOWCHART

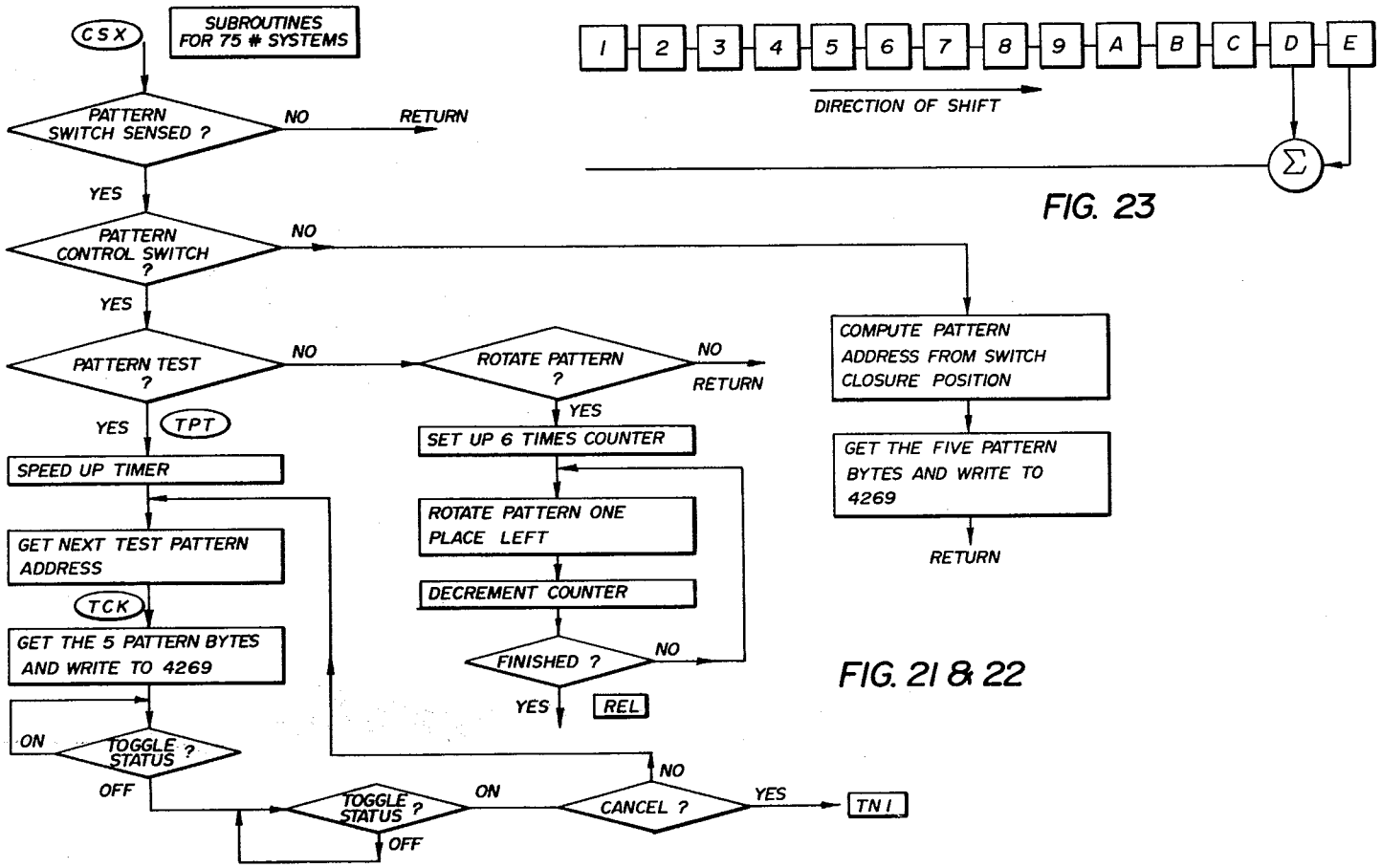
1
2
3
4
5
6
7
8
9
A
B
C
D
E
DIRECTION OF SHIFT
FIG. 23
CSX
SUBROUTINES FOR 75 # SYSTEMS
PATTERN SWITCH SENSED ?
NO
RETURN
YES
PATTERN CONTROL SWITCH ?
NO
YES
COMPUTE PATTERN ADDRESS FROM SWITCH CLOSURE POSITION
GET THE FIVE PATTERN BYTES AND WRITE TO 4269
RETURN
PATTERN TEST ?
NO
YES
TPT
ROTATE PATTERN ?
NO
RETURN
YES
SET UP 6 TIMES COUNTER
ROTATE PATTERN ONE PLACE LEFT
DECREMENT COUNTER
FINISHED ?
NO
YES
REL
SPEED UP TIMER
GET NEXT TEST PATTERN ADDRESS
TCK
GET THE 5 PATTERN BYTES AND WRITE TO 4269
TOGGLE STATUS ?
ON
OFF
TOGGLE STATUS ?
ON
OFF
CANCEL ?
NO
YES
TN I
FIG. 21 & 22

ELECTRONIC BINGO SYSTEM

This invention relates to an electronic circuit for providing and enhancing the operation of apparatus used in a game such as Bingo.

In a game such a Bingo, randomly selected numbers are called out in sequence of their selection by a game operator, and players utilize cards on which are printed numbers corresponding to some of those which are called. Since a smaller number of numbers than those randomly selected are printed on each of the cards, the players participate in a game of chance to establish which will first obtain a series of numbers in a predetermined pattern, such as in a straight line, two lines forming the letter "T", etc.

Such games have become highly popular, and as such, are often carefully controlled under the law. The randomness of selection of numbers, for instance, must be ensured, the possibility of any of the numbers being called must be equal to all others, and it is highly desirable, particularly in games which are open to the general public, to utilize a display which illuminates each number after it is called for the remainder of the game.

In one common form of the game, a transparent box or cage is provided within which are disposed a number of light balls such as Ping Pong balls, each of which carries one of the numbers to be called. A hole with a ball-catching channel forms an exit to the cage, and a centrally located fan at the bottom of the cage blows and scatters the balls. Since the only exit to the cage is the channel, one or more balls is blown into it, allowing the operator to select each ball in sequence out of the ball-catching channel, the numbers thereon therefore being rendered in totally random sequence.

The operator normally calls the number via a public address system after selecting the outer ball in the ball-catching channel, and he deposits the ball into a correspondingly numbered hole in a Bingo table. The ball is lightly posted into the hole, and is caught by a spring which holds it in its depressed position. Once depressed, the ball operates an actuator pin of a microswitch or leaf switch. Current passing through the switch is directed to a lamp immediately behind a translucent pane which carries a number painted thereon which corresponds to the number of the ball which had been called and is held in the correspondingly numbered hole.

In this manner each of the balls which had been called causes a corresponding number to be illuminated in the display for the remainder of the game, allowing the players to check all previously called numbers as the game progresses.

Once the game has been completed, the operator normally shifts the table, moving the balls past the microswitch locations, allowing them to fall into a bin or sink which has its exit into the lower box or cage.

The present invention is directed to an electronic circuit which interfaces the switch positions actuated by each depressed ball, and among other functions, illuminates the proper lamps in the display.

It should be noted that in the above-described Bingo system each switch corresponding to a ball position in the operator's ball table extends to a corresponding lamp via an individual wire; there is also a single ground return for all lamps. Bingo or similar games normally utilize 75 or 90 numbers and consequently it is clear that the cable from the Bingo table to the display must be extremely thick, heavy and unyielding. Furthermore, because of the large number of wires, it is costly and difficult to extend the display over a large distance as might be required at two ends of a Bingo hall (sometimes requiring the length of cable of as much as several hundred feet, for example).

With such a large number of wires, there is also the danger of breakage of one or more of them as the cable is flexed. This decreases the reliability of the cable as the Bingo table is set up or taken down at the end of each day's games, and it also introduces the possibility of short circuiting due to breakage of the wires. Breakage of the wires also introduces a possibility of danger to personnel utilizing the system, since the breakage could occur at a position adjoining apparatus which is touched by the operator or by the players. Clearly, flexing of the multi-wire cable repeatedly places substantial stress on each of the wires, and can result in reliability problems with the apparatus as well as a danger to the public due to the potential for shock.

Since such systems are wired directly from switch to light bulb to power supply, its manner of operation is fixed. The depression of a ball into the appropriate hole in the Bingo table results simply in the illumination of a corresponding light bulb.

The present invention, on the other hand, provides a display which is variable at the push of an operator's button. The last number which has been called is shown on the display board as an illuminated number, but continuously flashes to inform the players which number was last called. Once another number has been called, the flashing stops and the new number is displayed by a flashing lamp.

The operator is also able to signify a "win" by the illumination of various patterns of lights, for instance, all of the light bulbs may be caused to flash in sequence so as to portray a "starburst" moving pattern, which has been found to be an exciting display for players. Further, a local display for the operator begins flashing after a predetermined (and variable) period to indicate to him when the next number should be called, and thus provides an even pace to the game.

Of further significance in this invention is the reduction of the cable to contain no more than four individual wires. The length of the cable can be extensive, and have been tested as being reliable over as much as 1,000 feet, clearly sufficient for virtually all indoor locations. It should be noted that the aforenoted length is not limiting, but is merely the length to which the early prototype of this invention was tested.

It is not intended that this invention be limited for use with Bingo. Other displays such as advertising or other illuminated indicator boards as are often found in sports arenas or sports fields can use the inventive system. However, the following disclosure will be directed to an explanation of use in a Bingo game for each of description of the preferred, but not the only embodiment.

The advantages of the invention are obtained in a system for illuminating selected ones of a plurality of lamps located at a remote location comprising a microcomputer system including data and program memories connected to a central processing unit adapted to store and process signals representative of a selected crosspoint and signals representative of a processing sequence, and to derive and store signals representative of one or a sequence of said lamps to be illuminated as a result of translation of the processing sequence signals; means connected and controlled by the microcomputer system for scanning an array of crosspoints and for translating the closing of the selected crosspoints to a location signal representative of the location of the crosspoint in the array, and including storing means for storing the location signal; converter means connected to the storing means for translating the location signal into a serial bit stream signal representative of the addresses of one or more particular lamps to be illuminated, and a display bus connected to the output of the converter means for carrying the serial bit stream signal for connection to a serial bit stream signal decoding and lamp illumination circuit.

A better understanding of the invention will be obtained by reference to the description below, and to the following drawings, in which:

FIG. 1 is a block schematic of the invention;

FIGS. 2 and 3 form a block schematic of the microcomputer portion of the invention;

FIGS. 4, 5*a* and 5*b* form a schematic diagram of the input and output interface and controlling portion of the invention;

FIGS. 6, 7*a* and 7*b* form a schematic diagram of the decoding and lamp driving portion of the invention;

FIG. 10 is a plan of the storage locations for various crosspoint switch numbers, to be illuminated when operated, in the memory of the input-output peripheral;

FIG. 12 is a plan of the contents of the buffer store of the input-output peripheral;

FIG. 13 is a plan of the lamp positions of the game pattern display board;

Figure 14:
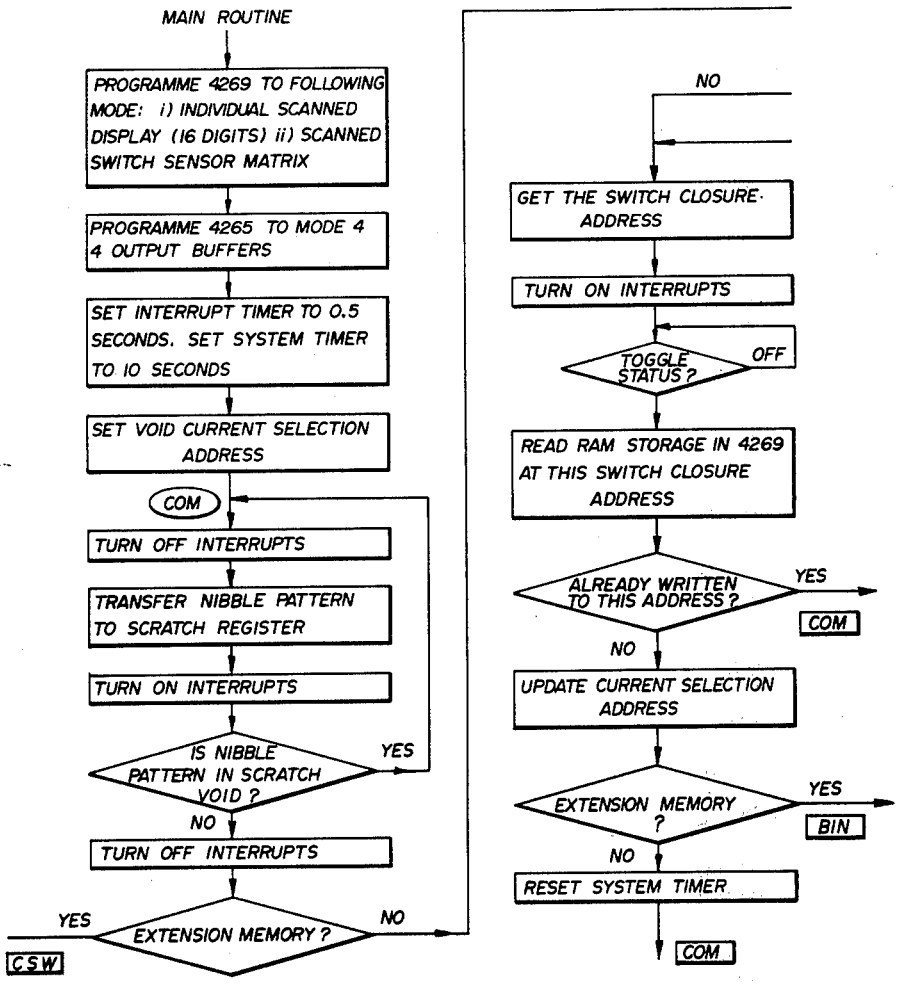
Figure 15:
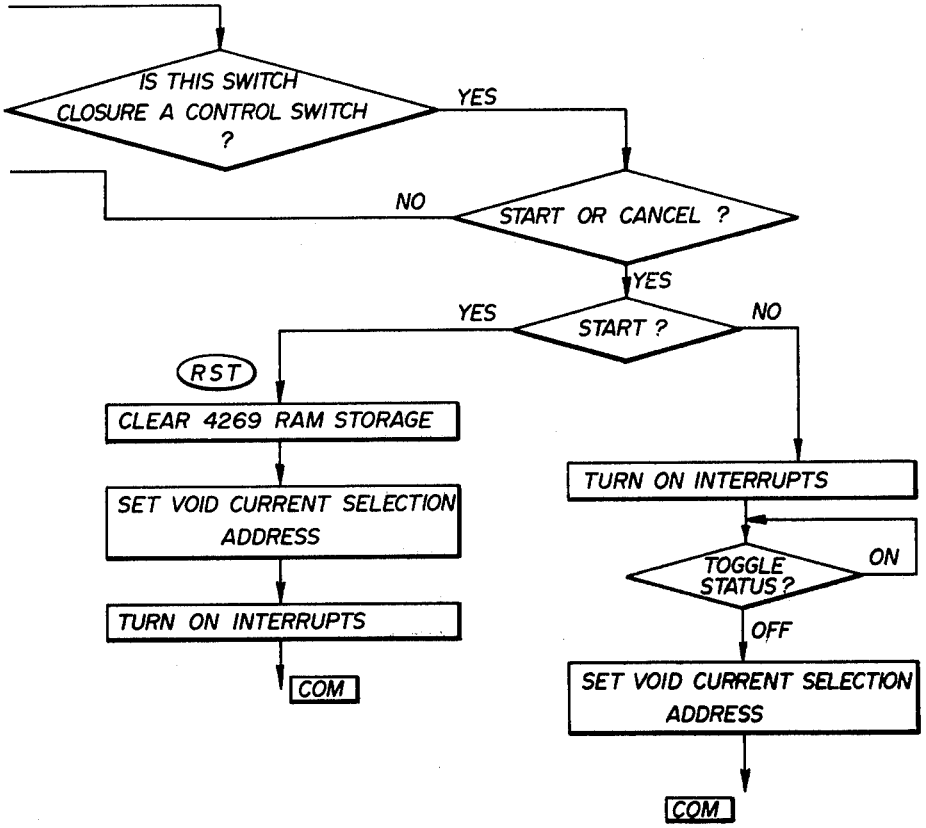
Figure 16:
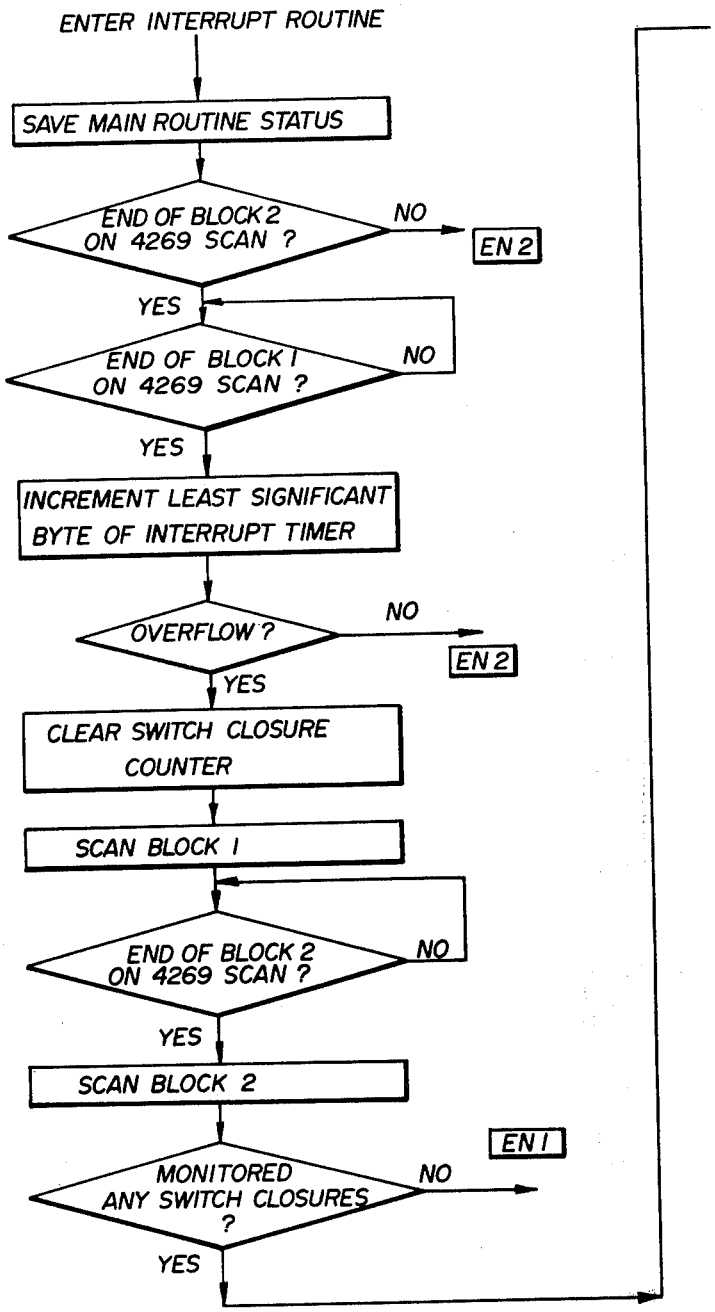
Figure 17:
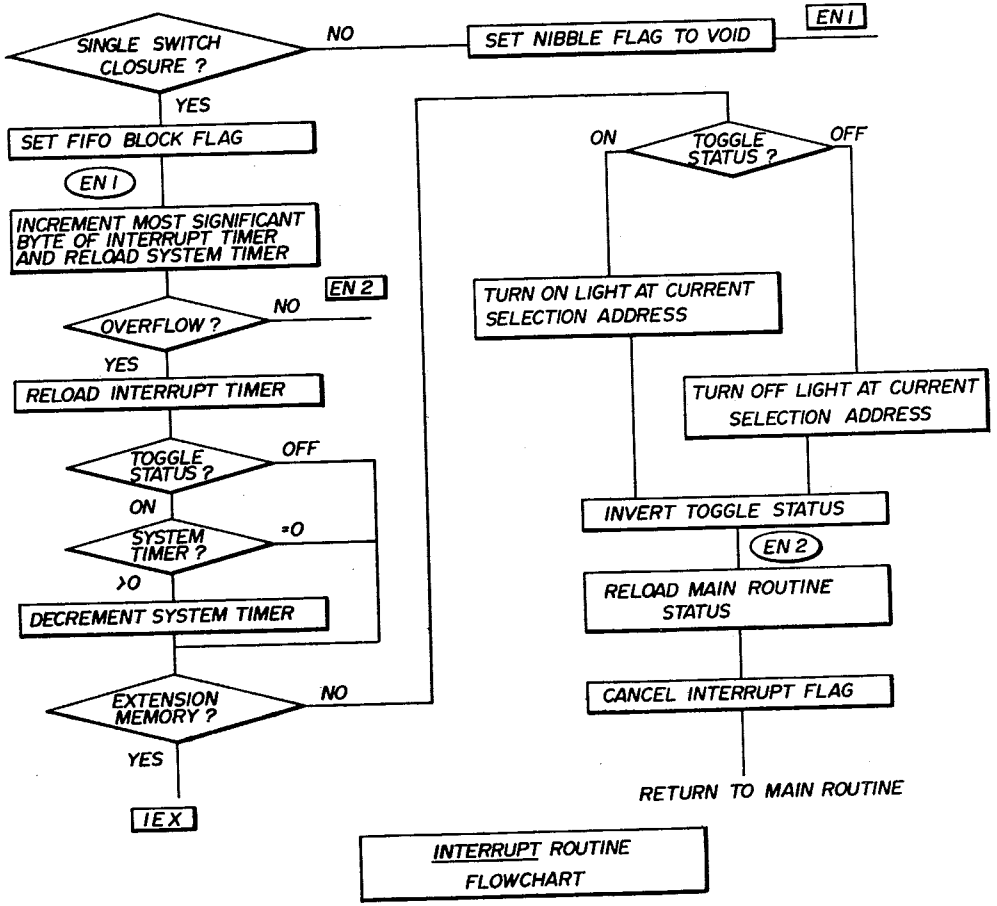
Figure 18:
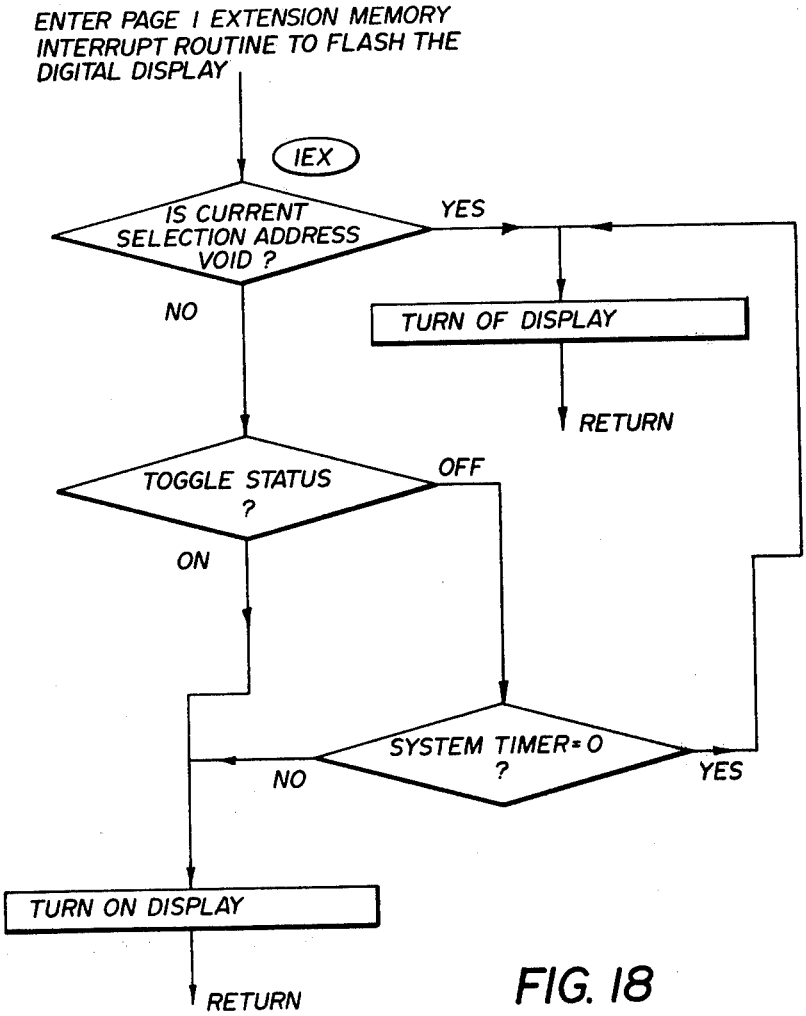
Figure 18A:
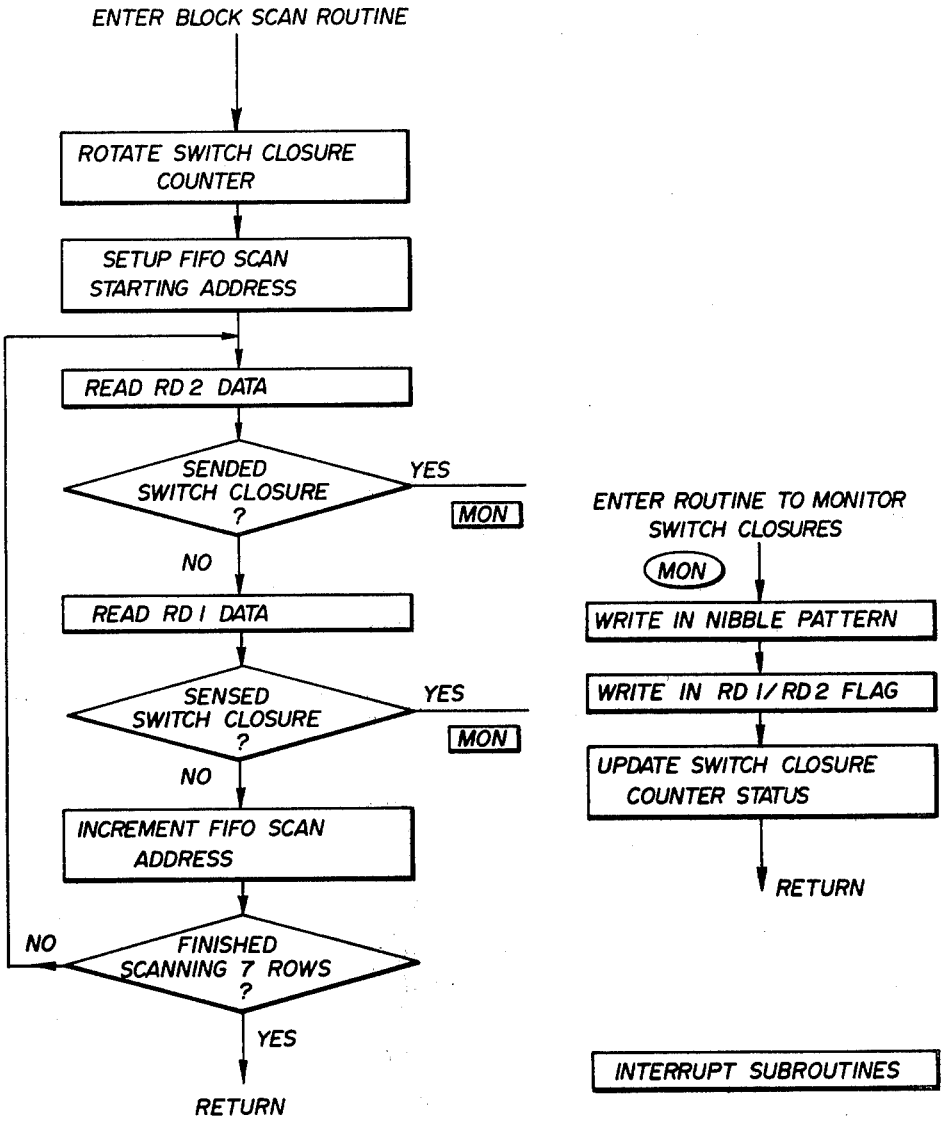
Figure 19:
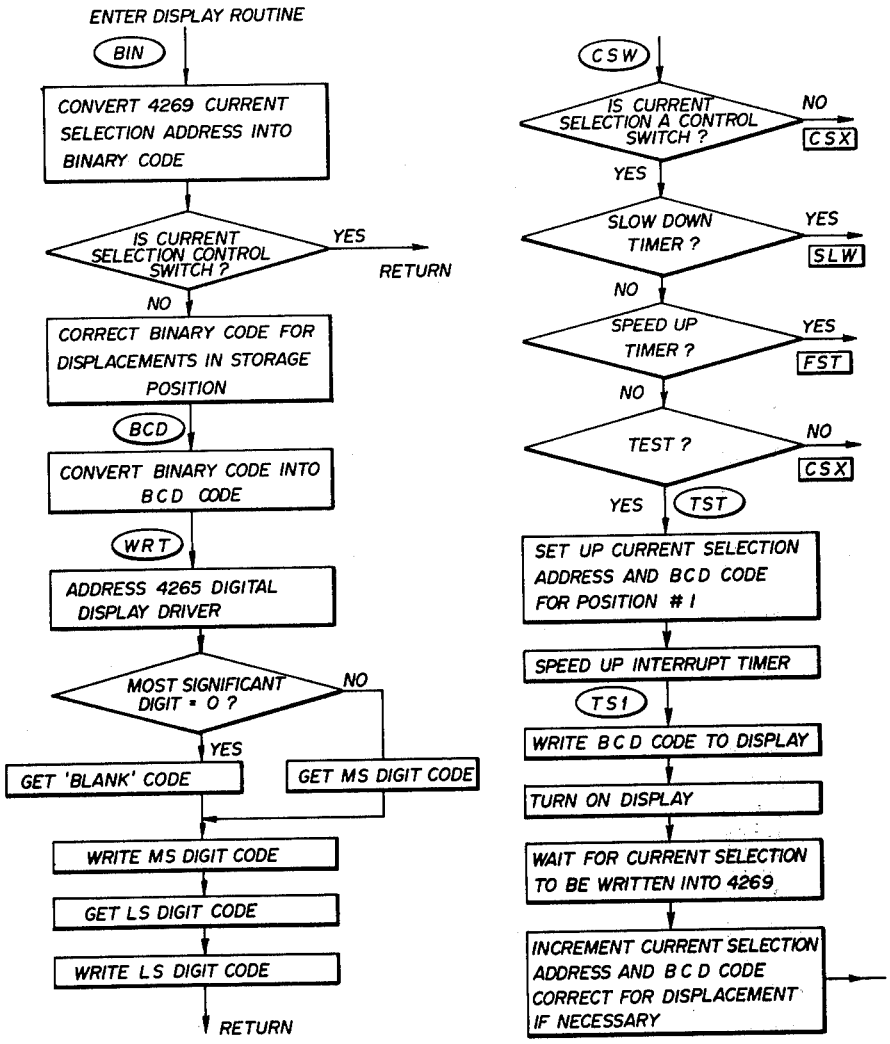
Figure 20:
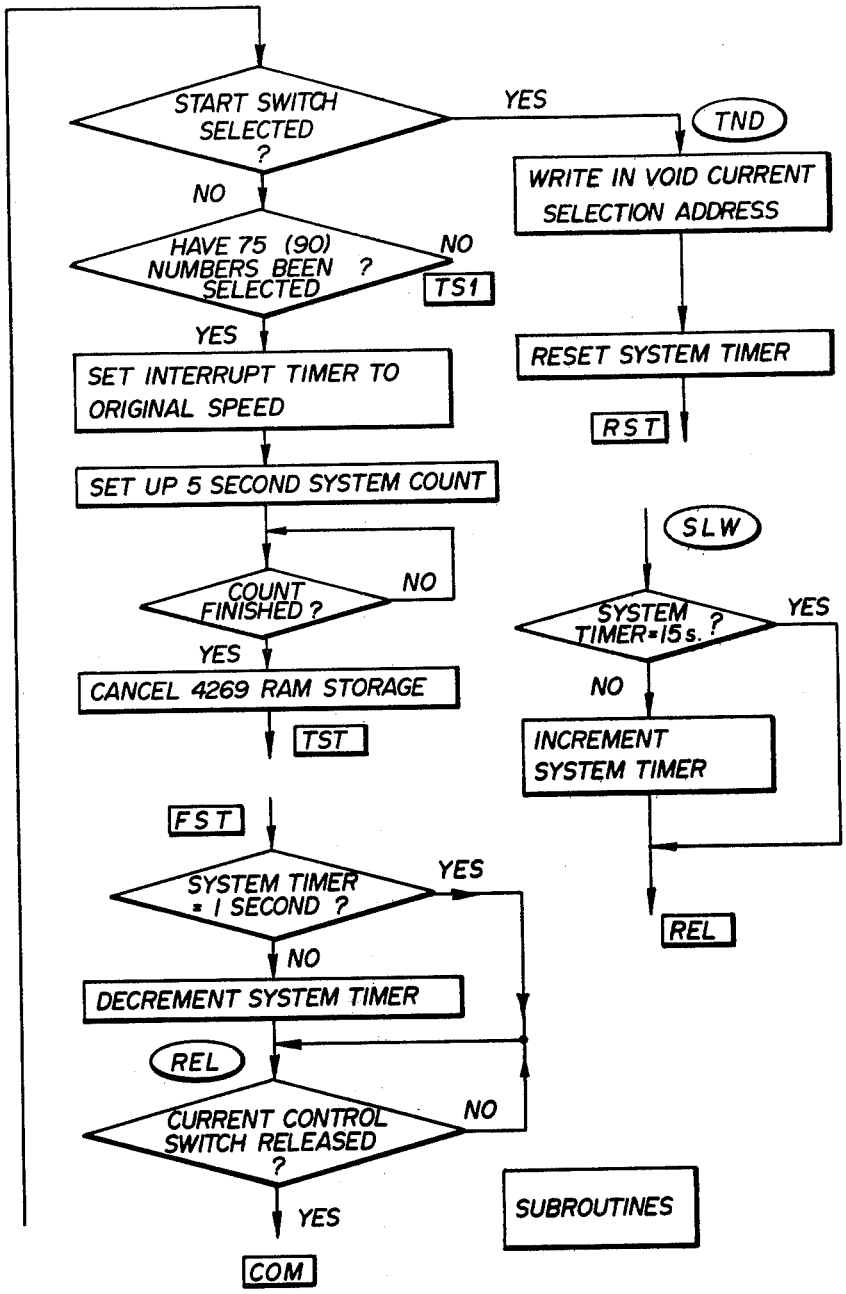

FIGS. 14 and 15 form a flow chart of the logic behind the formation of the signals stored and operated by the microcomputer in respect of the main program;

FIGS. 16 and 17 form a flow chart of the logic behind the formation of the signals stored and operated by the microcomputer in respect to the interrupt routine;

FIGS. 18 and 18*a* form a flow chart of the logic behind the formation of the signals stored and operated by the microcomputer in respect of the interrupt subroutine;

FIGS. 19 and 20 form a flow chart of the logic behind the formation of the signals stored and operated by the microcomputer in respect of the system subroutine;

FIGS. 21 and 22 form a flow chart of the logic behind the formation of the signals stored and operated by the microcomputer in respect of the display pattern subroutine; and FIG. 23 is a block schematic of a system for generating random numbers.

Figure 1:
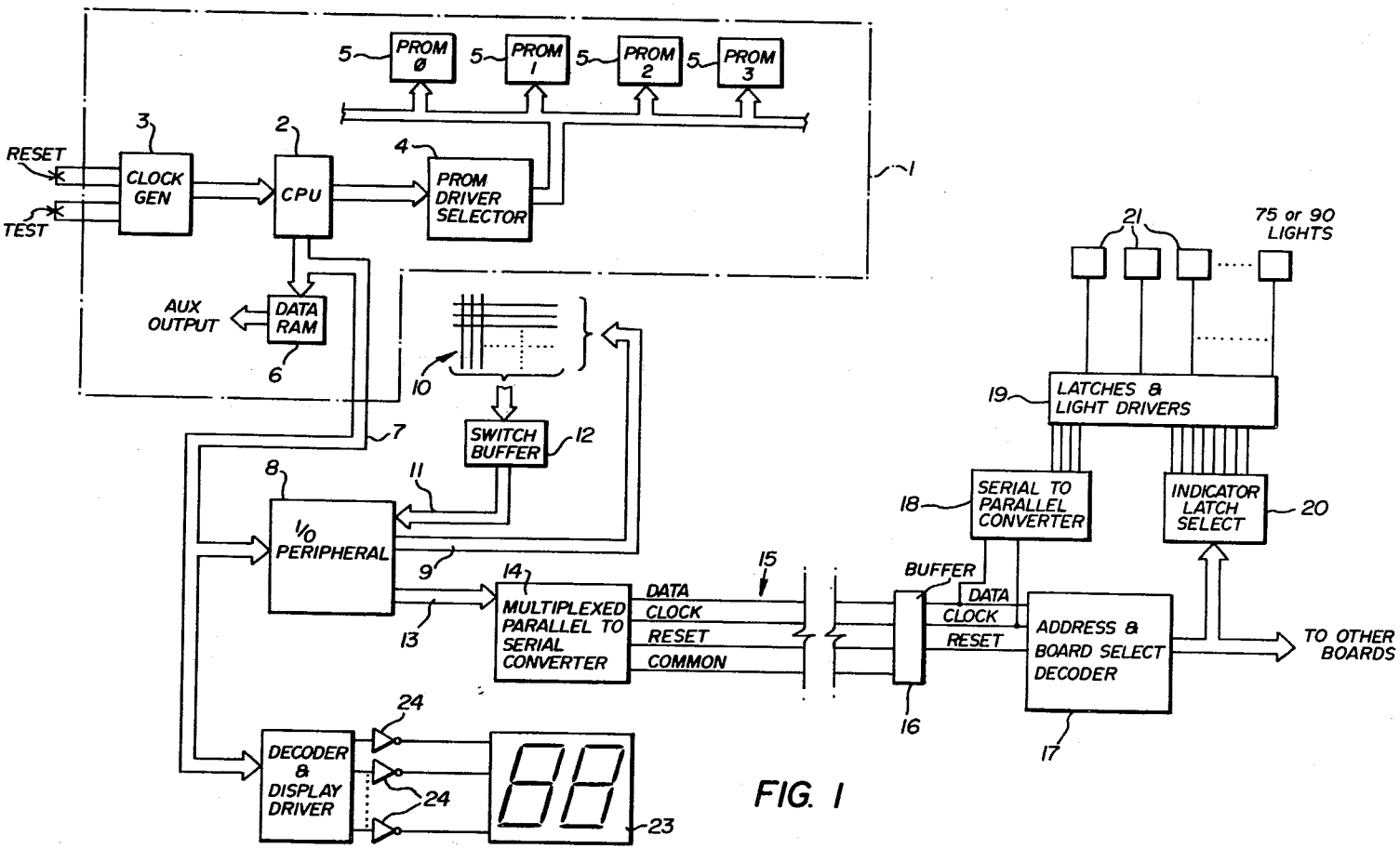

Turning now to FIG. 1, a microcomputer system 1 for use in this invention is shown. The system is comprised of a central processing unit 2, which is preferably type 4040 single chip 4-bit P-channel microprocessor which is available from Intel Corporation, Santa Clara, Calif.

Connected to the central processing unit is a clock generator 3, which is preferably type 4210A, also available from Intel Corporation, driven by a 5.185 megahertz crystal.

Also connected to the central processing unit 2 is a PROM (programmable read only memory) driver and selector 4, preferably type 4289 also available from Intel Corporation.

One or more PROMs 5, such as type 4702A, available from Intel Corporation, is connected to the PROM driver and selector 4. Associated with the PROMs 5 and driver and selector 4 can be one or more binary decoders (not shown in FIG. 1) for aiding in the selection of a particular PROM at a required time.

Also connected to the central processing unit 2 is a data RAM (random access memory).

The elements so far disclosed are connected together via address and data buses, as well as sync, clock, and other leads required for proper operation thereof. It is assumed that a person understanding this invention is able to assemble this microcomputer system, including determining the memory size required, and therefore the system has only been shown in block diagram. However, data sheets describing the interface, operation, inter-relationship, and programming of the specific type of elements noted above are available from the aforenoted Intel Corporation. For the embodiment described below, three 4702A PROMs are sufficient.

An output bus 7 of microcomputer system 1 contains four data leads $D_0$, $D_1$, $D_2$, $D_3$, a clock lead, a reset lead, a sync lead, and a clear memory lead, the latter useful for an external memory.

Output bus 7 is connected to an input-output peripheral integrated circuit 8. Preferably this peripheral is type 4269 which is available from the aforenoted Intel Corporation. This integrated circuit is comprised of a random access memory, means for providing a scanning output signal, means for sensing a scanned input signal, a bus interface circuit, instruction decoding, control logic and timing circuitry, and display registers, as well as interconnection circuits. As its mode of operation is published, which publication is available from Intel Corporation, a description of its internal operation will not be described.

Its scanning output terminals, however, are connected via bus 9 to a matrix of crosspoints 10. The output of the matrix of crosspoints 10 is connected to a scanned signal input to the input-output integrated circuit via bus 11, preferably through a crosspoint switch buffer 12.

The output of the internal random access memory from the display register of peripheral 8 is applied via bus 13 to a parallel-to-serial converter 14 which changes the parallel form of the output to serial form on a data lead. The output of the converter 14 is also applied to a clock lead for carrying clock pulses, to a reset lead for clearing the output display, and to a common lead.

The four leads noted above are sufficient to carry all required information to the system display. Due to the small number of wires, the cable can be twisted and passed along and through locations with very little stress in comparison to that which would be incurred by a 76 or 91 wire cable.

The end of the cable 15 is connected to a buffer 16 which reconstitutes the square waveform of the pulses carried by cable 15, and raises their amplitude to a level sufficient to drive the following logic. The data, clock and reset leads at the output of buffer 16 are applied both to an address and board select decoder 17 and to a serial-to-parallel converter 18. The latter converter converts the data back into parallel form and is applied in parallel to a plurality of latches, which in turn are connected to a plurality of light drivers (both in block 19).

The output of the address and board select decoder 17 is connected to an indicator latch select circuit 20, the output of which is connected to individual ones of the latches. Accordingly a data signal is applied from the serial-to-parallel converter 18 to all latches 19 together, and the indicator latch select circuit 20, driven by the address and board select decoders 17 enables the specific latches at specific times to register and hold the data signal which is applied at that particular time from the serial-to-parallel converter 18.

Individual lamps 21 connected to the light drivers, for instance through silicon controlled rectifiers or switches, are accordingly lit up at locations determined by the data signal and the address carried by cable 15, thus providing a display for the players of the game.

Preferably the parallel-to-serial converter 14 is integrated circuit type 74151 available from Fairchild Corporation. Serial-to-parallel converter 18 is preferably integrated circuit type 7496, address and board select decoder 17 and latch select 20 are preferably comprised of type 7442 in conjunction with type 7493 integrated circuits, and latches and light drivers 19 are preferably comprised of integrated circuit type 7475; all are available from the aforenoted Fairchild Corporation.

Also connected to microcomputer output bus 7 is a decoder and display driver 22, to the output of which is connected a two digit digital display 23 through drivers 24.

In operation, a crosspoint is closed somewhere within the matrix of crosspoints 10, by the operator depressing a numbered ball which has been randomly selected against a crosspoint switch which crosspoint is similarly numbered. Each of the row conductors of the matrix of crosspoints is scanned in sequence from scanning output bus 9 of input-output integrated circuit 8, under control of the microcomputer system 1. With the closing of a crosspoint, the scanning pulse at the particular row conductor of the crosspoint is transferred to the adjacent column conductor and via switch buffer 12, is applied to one of the leads of input bus 11. A signal on one of the leads of input bus 11 causes a system interrupt to be generated, and under control of the microcomputer system, the input-output peripheral translates the matrix position to an indicator lamp address and data signal as to which addressed lamps are to be illuminated, shut off, flashed, etc., at particular times.

At the same time, the translated address appears at the output bus 7 of the microcomputer system 1 due to the microcomputer system having performed the translation and providing the data signal back to integrated circuit 8. The same data signal is applied to the decoder and display driver 22, which decodes the data and causes the two digit digital display 23 to provide an indication of the selected crosspoint matrix location, as a numerical output. This numerical output is the same as will be illuminated by lamp 21, once actuated.

Closure of a further matrix crosspoint, one which has been predetermined for control, is then closed. As before, this causes generation of a system interrupt which recognizes the particular crosspoint which has been closed. In this case, the microcomputer system 1 causes an output signal to be generated on bus 13 which designates which lamp 21 is to be illuminated to display the number similar to that shown on digital display 23.

Converter 14 changes the data on the parallel bus 13 to serial form, which is applied to cable 15, on the data, clock, and reset leads, with a common return.

At the other end of cable 15, adjacent the display, is connected buffer 16 which removes noise signals which may have been imposed on the signals carried by cable 15, and raises their potential level and shorten their rise time to that required by converter 18 and decoder 17. Converter 18 is connected to the output of buffer 16 and changes form of the signals to the parallel form required by the latches of block 19. The required data is applied to all latches in parallel.

The output of buffer 16 is also connected to the input of address and board select decoder 17. This circuit determines first that it is the subject display which is to be addressed, and it further decodes the address of the specific lamps which are to be illuminated. The output signal of decoder 17 is connected to the input of indicator latch select circuit 20, the output of which is connected to individual latches of block 19. Accordingly its decoded address enables a specific latch or group of latches to operate and store the data signal from converter 18 for the illumination or shutting off of a particular lamp 21 at a particular time. The output signal of the latches are applied to light drivers, which cause operation of shutdown of lamps 21.

In brief review, the aforenoted apparatus displays a selected number to the operator on two digit display 23 and at the same time illuminates the correct number on the display. If the ball was placed in the wrong hole, a further cancellation crosspoint is closed, which turns off the latest display number; the operator then places the ball in the correct hole.

It is preferred that upon depression of each crosspoint indicating selection of a number to be displayed, the data and the address to which the data is applied should cause the light to turn on and off sequentially, i.e. to flash. Once a following crosspoint has been closed, the data for the preceding lamp is changed causing steady illumination, and the data directed to the address of the lamp corresponding to the newly closed crosspoint causes the associated newly selected lamp to flash.

With the above general system configuration described, and the assumption that a person skilled in the art fabricating this invention understands the operation of the specific integrated circuits noted above, a description will now be given of the specific inventive circuit by which the elements are interconnected, followed by a description of the form of signals to be stored in the memories of the microcomputer system and of the input-out peripheral integrated circuit 8 to enable them to operate in accordance with this invention. The specific forms of the signals which are stored to cause operation of the microcomputer system (referred to below as programs) are alternative depending on the specific approach taken by the program-designer. Accordingly since various forms of programs can be written to fulfill the invention, its basic logic of formation will be described with reference to a flow chart from which the program can easily be written by a person skilled in the art. It is believed that this is a clearer description by which the form of the signals to be stored by the microcomputer to control its operation may be understood, rather than by providing lists of binary bits and specific storage locations, or by providing lists of mnemonics. However by way of completeness an Appendix to this specification provides specific mnemonic lists, forming an operable and useful program for implementing operation.

Figure 2:
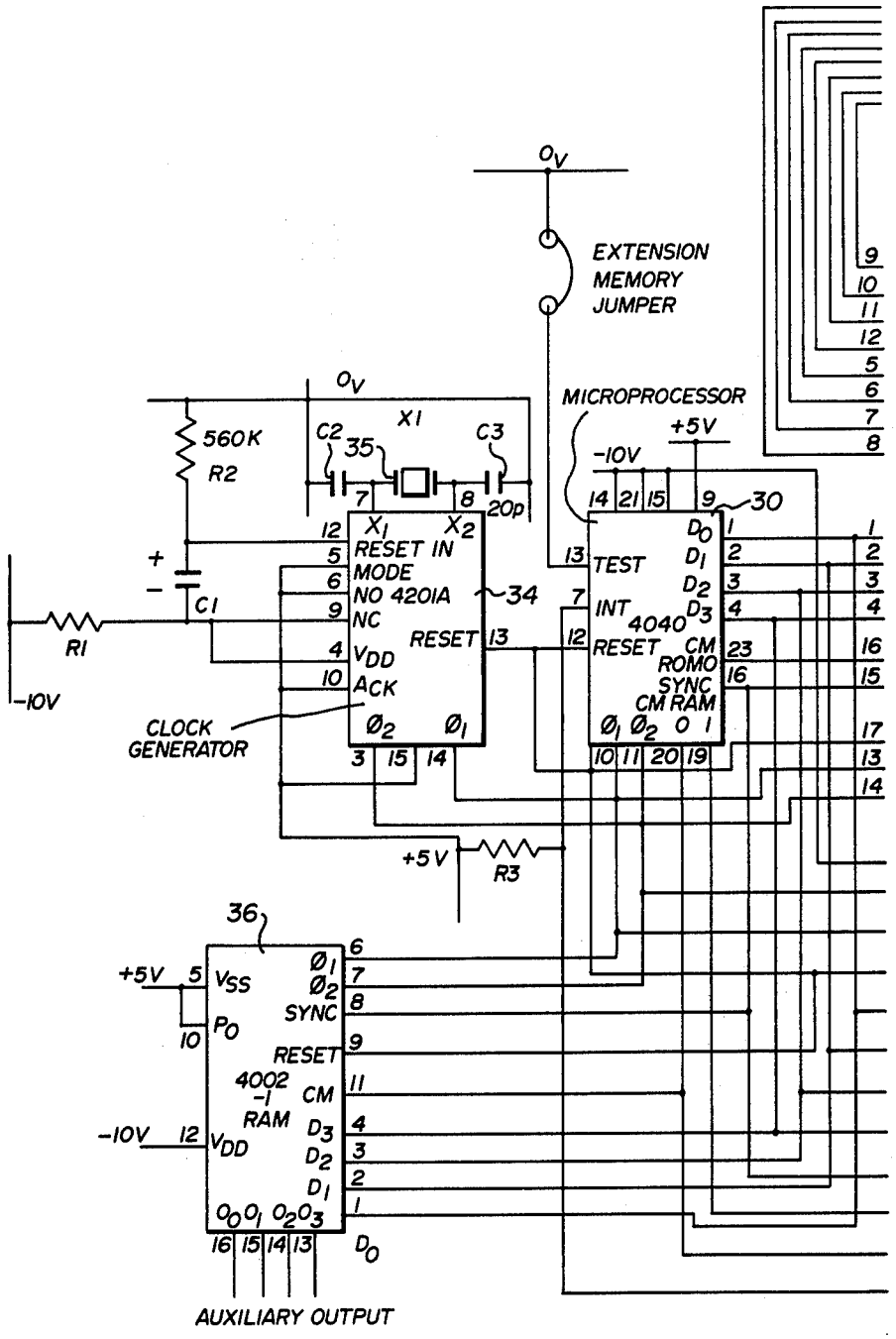
Figure 3:
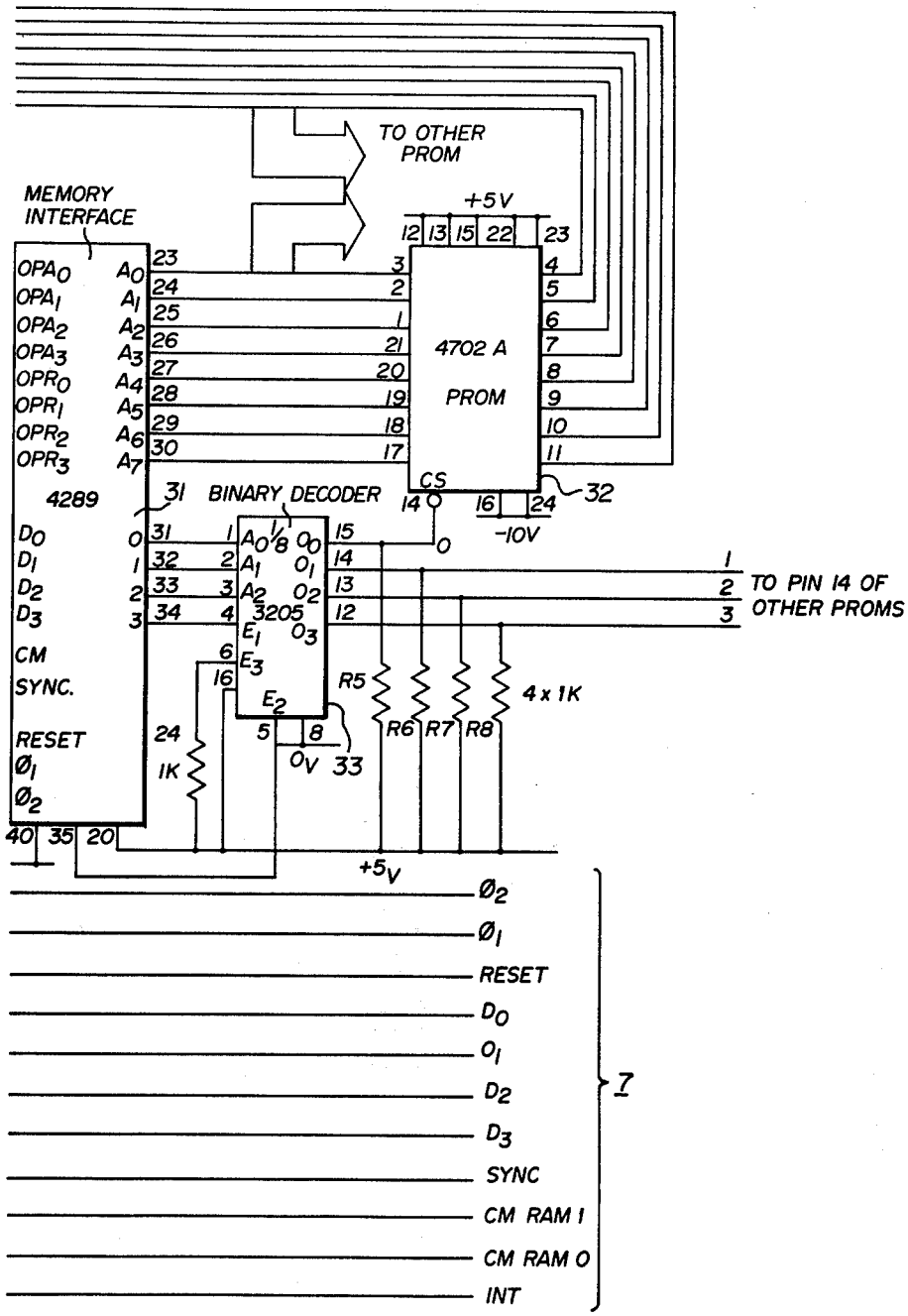

The microcomputer system is shown in more detail in FIGS. 2 and 3, and its structure will be briefly described. Microprocessor 30 is connected at its data terminals $D_0$, $D_1$, $D_2$, and $D_3$ to similarly identified data terminals of memory interface integrated circuit 31. This circuit provides the PROM drive and selection function described earlier with reference to FIG. 1. Its data output terminals $A_0$–$A_7$ are connected to the data input terminals of PROM 32, which has its own output terminals connected to input terminals $OPA_0$–$OPA_3$ and $OPR_0$–$OPR_3$ of integrated circuit 31.

Memory interface integrated circuit 31 also has address output terminals $C_0$–$C_3$, which are connected to input terminals $A_0$–$A_2$ and $E_1$ of 1 out of 8 binary decoder 33. The address output terminals $O_0$–$O_3$ are individually connected to specific PROMs, in order that a specific PROM can be addressed to apply or receive data on the data bus interconnecting the PROMs to the memory interface.

Also connected to the microprocessor 30 is a clock generator 34, to which a 5.185 megahertz crystal 35 is connected. Clock generator 34 is connected to microprocessor 30 via corresponding reset terminals, and via correspondingly numbered clock frequency terminals $\phi_1$ and $\phi_2$. The aforenoted clock output and reset terminals are also connected to memory interface 31. Sync terminals of the microprocessor and memory interface are also interconnected.

The clock leads $\phi_1$ and $\phi_2$, the sync lead, the reset lead and the four data leads $D_0$–$D_3$ are also connected to a RAM 36, preferably being a 320 bit random access memory with a 4 bit output port on leads $D_0$–$D_3$. An auxiliary output from the RAM is obtainable at output terminals $O_0$–$O_3$.

The aforenoted leads are accessed as the microcomputer output bus 7 also including clear memory leads CM RAM 1 and CM RAM 0 from the microcomputer 30. The latter lead is connected to RAM 36, and functions to clear stored data signals out of that memory upon control by microprocessor 30.

Other resistors, capacitors and power leads are shown for appropriate connection to the aforenoted elements. The structure and mutual operation of the elements of the microcomputer as well as the nature of the stored program signals are within the skill of a person skilled in the art, and full details of their operation is obtainable from the aforenoted Intel Corporation.

Figure 4:
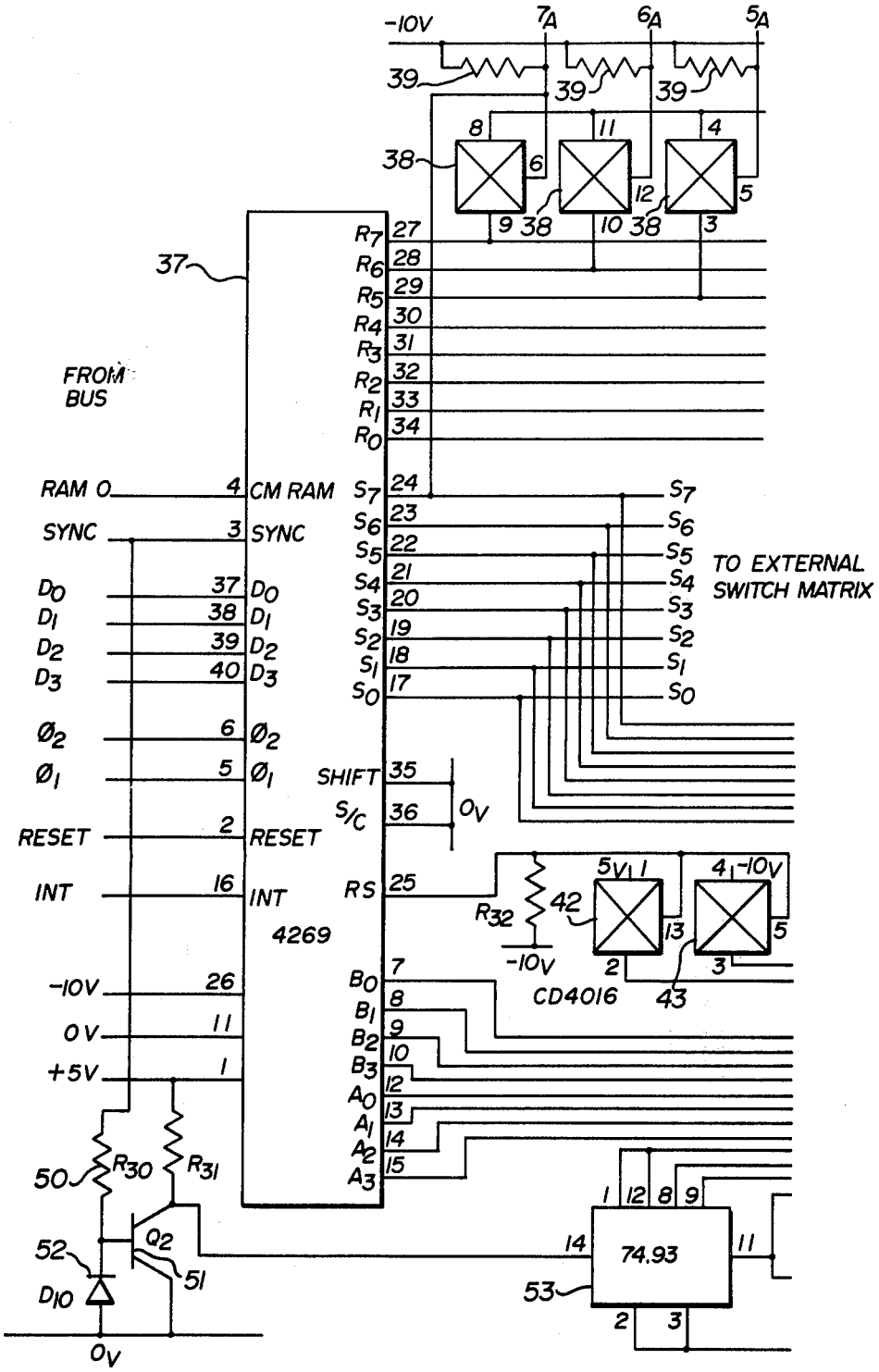
Figure 5A:
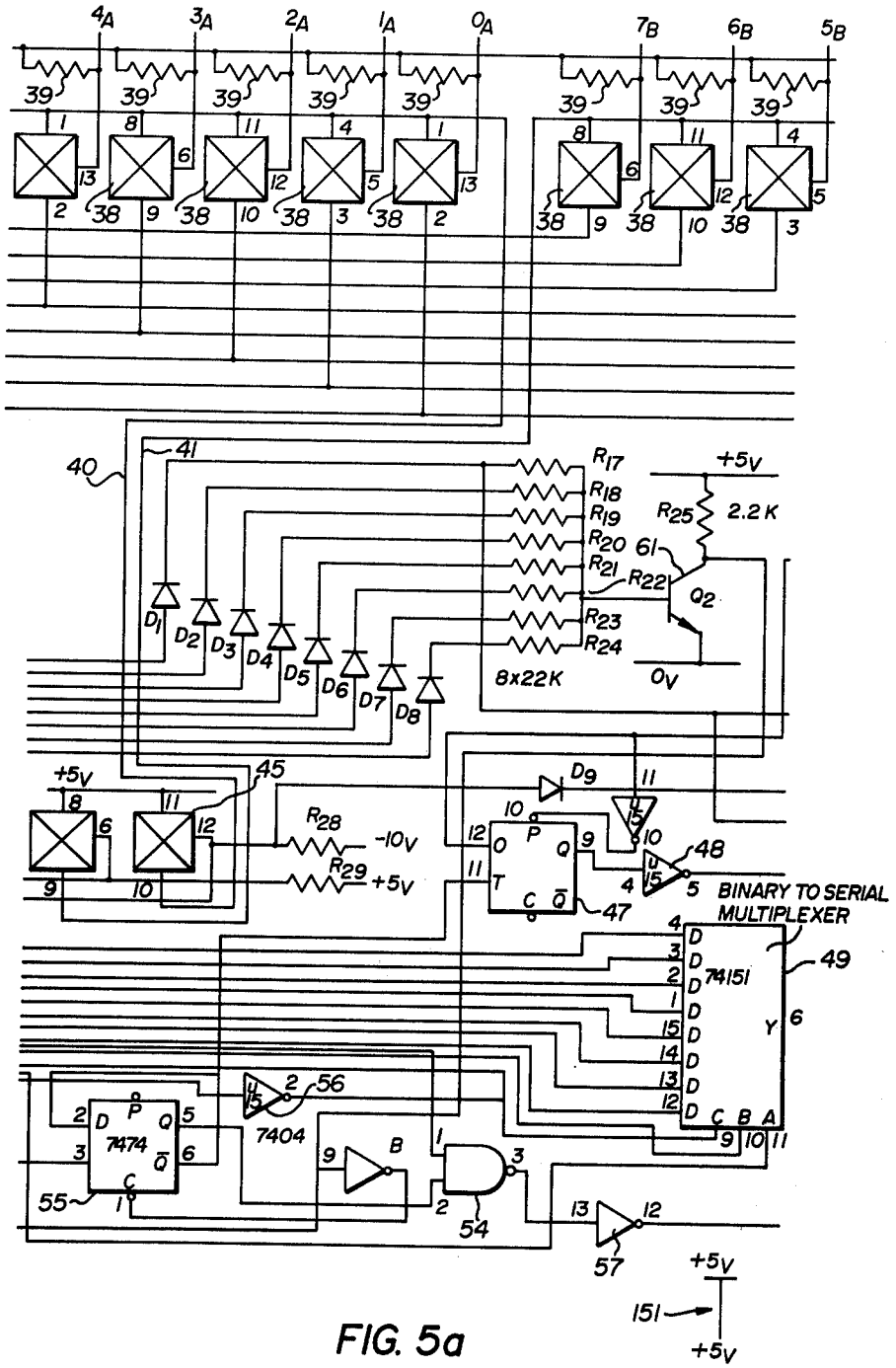
Figure 5B:
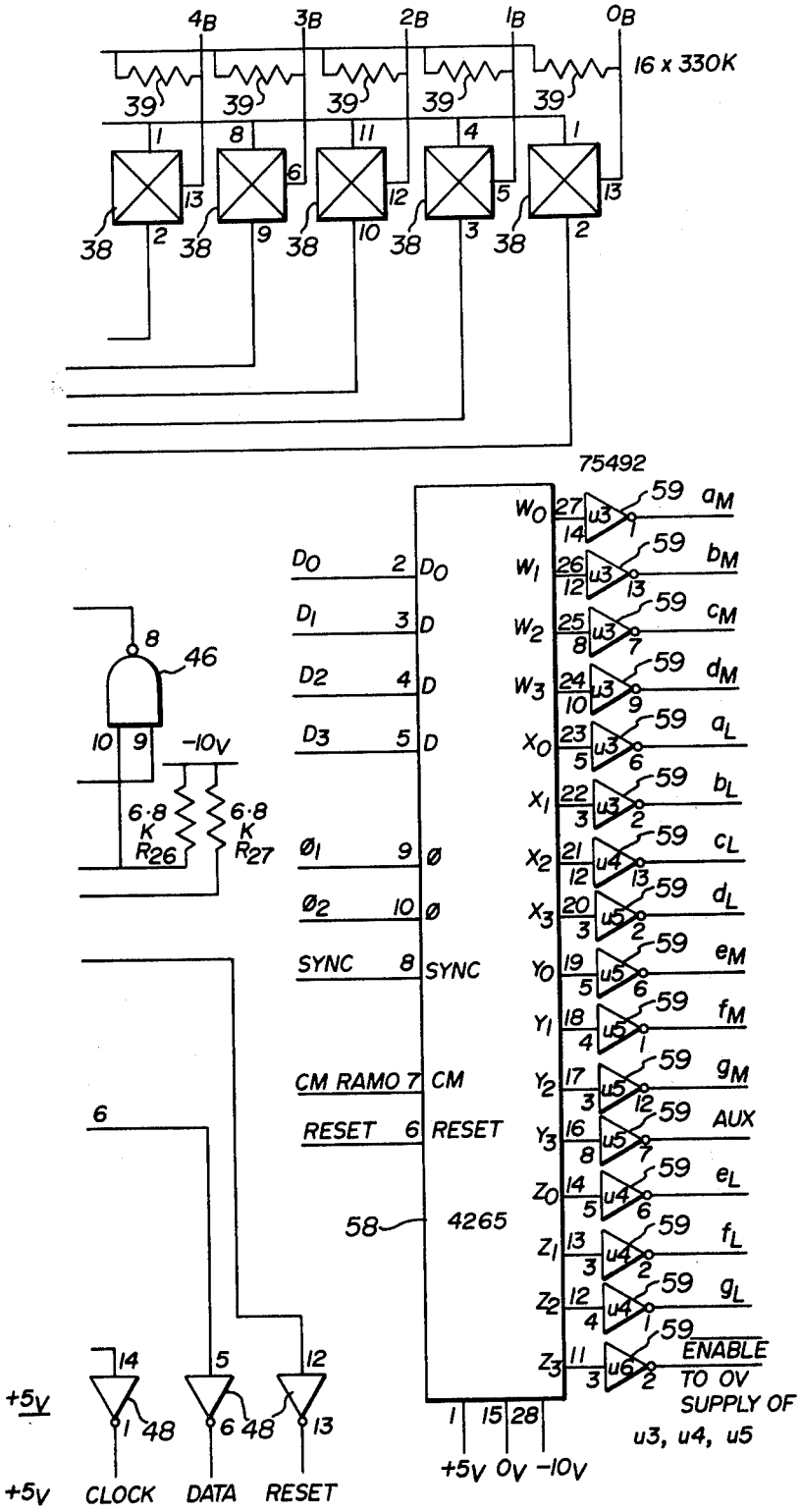

Turning now to FIGS. 4 and 5, the input-output control structure is shown. It will be understood that an external switch matrix should be used, preferably comprised of rows and columns of conductors which can be made to contact at a particular crosspoint. In the Bingo form of the game, crosspoint contact is made by depressing a numbered ball at the intersection of a similarly numbered row and column conductor. A suitable crosspoint matrix is described in Canadian patent application Ser. No. 290,796, filed Nov. 14, 1977, invented by Graham A. Jullien. However, the present invention is not limited thereto; the crosspoint array can be made of microswitches having one terminal of each row of switches connected together, and one terminal of each column of switches connected together.

For example, in the 90 number game there might be 8 row conductors and 16 column conductors to provide 128 crosspoints, which provide sufficient crosspoints both for the numbers and for control functions.

Input-output peripheral integrated circuit 37, as noted earlier, includes means for scanning an array of terminals $S_0$–$S_7$ by applying a high level signal to each terminal in sequence. Each terminal $S_0$–$S_7$ is connected to a respective horizontal conductor of the crosspoint matrix. Input-output peripheral 37 also is comprised of 8 scanned input terminals $R_0$–$R_7$. Each of these terminals is connected to each of 8 vertical conductors in two groups, of the crosspoint matrix.

The structure is also comprised of sixteen externally enabled electronic switches, preferably CMOS switches 38. Each of the CMOS switches contains an input terminal, which terminals are divided into two groups $0_A$–$7_A$ and $0_B$–$7_B$. Each of the input terminals is connected to each of the 16 vertical conductors. A resistor 39 connects each of the 16 CMOS switch input leads to a constant voltage plane, −10 V.

The output terminals of the 8 CMOS switches to which input terminals $0_A$–$7_A$ are themselves connected to the scanned input terminals $R_0$–$R_7$ of the input-output peripheral 37. The output terminals of the CMOS switches having input terminals $0_B$–$7_B$ are individually connected in parallel with the output terminals of the first set of CMOS switches to scanned input terminals $R_0$–$R_7$ of input-output peripheral 37.

It should also be noted that scanning output terminal $S_7$ is connected directly to input terminal $7_A$ of the last CMOS switch 38.

The enable input terminals of the CMOS switches having input terminals $0_A$–$7_A$ are connected together to enable lead 40, and the enable input terminals of the CMOS switches having input terminals $0_B$–$7_B$ all connected together to enable lead 41.

The input-output peripheral integrated circuit 37 also has an RS output terminal which is at a high level for the duration of each alternate scan, and is at low level for each alternate scan. This output terminal is connected to the input terminals of a pair of CMOS switches 42 and 43. The output terminals of CMOS switches 42 and 43 are both connected to the input terminals of CMOS switches 44 and 45, one input terminal of which is connected in a circuit path to a −10 V source, and the other of which is connected in a circuit path to a +5 V source, both through a pair of resistors. With the power supply input of switch 42 connected to +5 volts and the power supply input of switch 43 to −10 V, and both of switches 44 and 45 to +5 V, the resulting operation of the 4 switches when alternately high and low level signal is applied to the input of switches 42 and 43 from the RS terminal is to apply high level signals alternately to enable leads 40 and 41.

Accordingly it will be seen that as a high level signal appears on leads $S_0$–$S_7$ of the input-output peripheral 37 in sequence, for the entire duration there will be a high level signal appearing on the RS terminal, which, with the operation at this time of CMOS switches 43 and 44, causes a high level signal to appear on enable lead 41. Accordingly for the present scan period CMOS switches 38 which have input terminals $0_B$–$7_B$ are enabled.

With no crosspoint being closed, none of the latter CMOS switches will conduct, and there is no scanned input signal applied to terminals $R_0$–$R_7$ of the input-output peripheral 37. Should one of crosspoints have been closed the high potential level signal appearing on one of the row conductors of the matrix leads connected to terminals $S_0$–$S_7$ at a particular time during the scanning cycle is transferred to the column conductor at the crosspoint, and to the input of one of the CMOS switches having input terminals $0_B$–$7_B$. Since this group of CMOS switches had been enabled via enable lead 41, the high level signal is passed through a corresponding CMOS switch and is applied to one of the input terminals $R_0$–$R_7$.

During the immediately following scanning cycle, the signal level on the RS lead is at low level. CMOS switches 42 and 45 operate to cause the potential on enable lead 40 to rise in level, and the potential on enable level 41 to drop to low level. Accordingly, the CMOS switches which have input terminals $0_B$–$7_B$ are disabled, and CMOS switches 38 which have input terminals $0_A$–$7_A$ are now enabled.

Should a crosspoint switch closure be detected, of course it will have no effect during this scanning cycle on the CMOS switches which are now disabled. However, should it correspond to a vertical matrix conductor which is connected to one of the CMOS switches which is now enabled, high level signal from the appropriate sequentially scanning terminals $S_0$–$S_7$ is transferred through the closed crosspoint to the input of one of the terminals $R_0$–$R_7$.

The particular input output peripheral 37 used in the present embodiment, type 4269, is only capable of storing the switch closures of 64 crosspoints, (i.e., made up by a block matrix of 8 by 8 switches). However the Bingo game utilizes a larger number of crosspoint switches, i.e. 75 or 90 in number plus control switches. To recognize and scan the remaining switches, an additional block of switches comprising a further 8 by 8 matrix is used. One switch, of column 8, row 8 of the second block is permanently closed. A system interrupt is generated when this (or any other) switch closure is sensed. With the corresponding switch of column 8, row 8 of the first block of switches, the operation program provides means for detecting when the first or second block of switches has been completely scanned, since the binary bit in the RAM portion of peripheral 37 at the location for column 8, row 8 is caused to change state every time the corresponding switch of the second block of switches is scanned. In this manner the switch closure positions from the two blocks of crosspoint switches are separated. The capabilities of the peripheral 37 is thus extended from 64 crosspoints to 126 (128 less 2). The program for implementation will be described in more detail below.

The counting of memory storage locations continues continuously for each successive scanning cycle until the high level input interrupt from the aforenoted column 8, row 8 crosspoint, or from another crosspoint, is received. With reception of this interrupt signal, there is a recycling and restarting of the count of memory locations from the beginning, which is of course coincident with the beginning of the first of the two scanning cycles. Preferably the interrupt is set to occur every 5 milliseconds.

The column 8 scanning output terminal $S_7$ is connected through a diode $D_1$ to the input of AND gate 46. The other input of AND gate 46 is connected through a diode $D_9$ to the enable input of CMOS switch 45 which, it will be recalled, when activated, causes a high level output signal on enable lead 40. AND gate 46 therefore will be activated at the same time as CMOS switch 38 having input terminal $7_A$, that is, when the scanning output terminal $S_7$ is active, as well as enable lead 40 which causes the enabling of the CMOS switches 38 to which input terminals $0_A$–$7_A$ are connected. In short, AND gate 46 provides an output signal at the same time that terminal $R_7$ on the input-output integrated circuit 37 is operated directly from $S_7$ terminal via its direct connection to terminal $7_A$; there is direct coincidence with the interrupt signal.

The output terminal of AND gate 46 is connected to the O terminal of flip flop 47, as well as through an inverter to the P terminal. The signal at the Q output of flip flop 47, after being applied to LED driver 48, is applied to the reset lead of the output cable to display.

As was noted earlier, the input-output peripheral 37 contains a pair of display registers which have output terminals $B_0$–$B_3$ and $A_0$–$A_3$, forming an 8 bit parallel bus output. There terminals are connected via the 8 parallel leads of the bus to $D_0$–$D_7$ of a binary to serial multiplexer 49. The output of multiplexer 49 is applied to the input of a line amplifier 48, the output of which is applied to the data lead of the output cable.

The individual leads of the output bus 7 described earlier are connected to corresponding terminals of the input-output peripheral 37, a clear memory CM RAM O terminal (for the internal RAM of peripheral 37), a sync terminal, data terminals $D_0$–$D_3$, clock inputs $\phi_2$ and $\phi_1$, reset, and common lead INT.

A signal on the CM RAM O lead clears all data signals stored in the memory of the input-output peripheral 37. A signal on the sync lead indicates the beginning of an instruction, i.e., the beginning of a complete scanning cycle, etc. It is from this lead that a clock signal is developed for display.

The sync lead is connected through an isolating resistor 50 to the base of transistor 51, to which a base diode 52 is connected to ground. The collector output of transistor 51 is connected to the input of a 4 bit binary counter 53, the first count output of which is connected to one input of AND gate 54. Another count output of binary counter 53 is connected to input T of flip flop 55 as well as to inverter 56.

Other count outputs of four bit binary counter 53 are connected to the A and B clock inputs of binary to serial multiplexer 49, and the output of inverter 56 is connected to clock input C of multiplexer 46. The particular count output terminals which are connected to the A, B or C terminals of multiplexer 49 and to flip flop 55 are shown for the noted part numbers, and are determined by the required timing, and should other components than those described be used, their connections are left to the person skilled in the art.

It is preferred that the 4 bit binary counter be type 7493 available from Fairchild Corporation, and that flip flop 55 should be type 7474 available from the same source.

The Q output of flip flop 55 is connected to the second input of AND gate 54. The output of AND gate 54 is connected to inverter amplifier 57, the output of which is connected to a line amplifier 48, the output of which is applied to the clock lead of cable 15.

There should clearly be a large division between the frequency of the sync pulse on the sync lead and the pulses appearing on the clock lead. However, the operation of binary counter 53 provides timing signals to multiplexer 49 to sequence the serial format output bits corresponding to the parallel format input bits applied to it, in synchronization with the clock pulses derived through AND gate 54.

The binary to serial multiplexer 49 is preferably integrated circuit type 74151 which is available from Fairchild Corporation. Amplifiers 48 are preferably each type 7549 which are available from the same source.

Figure 8:
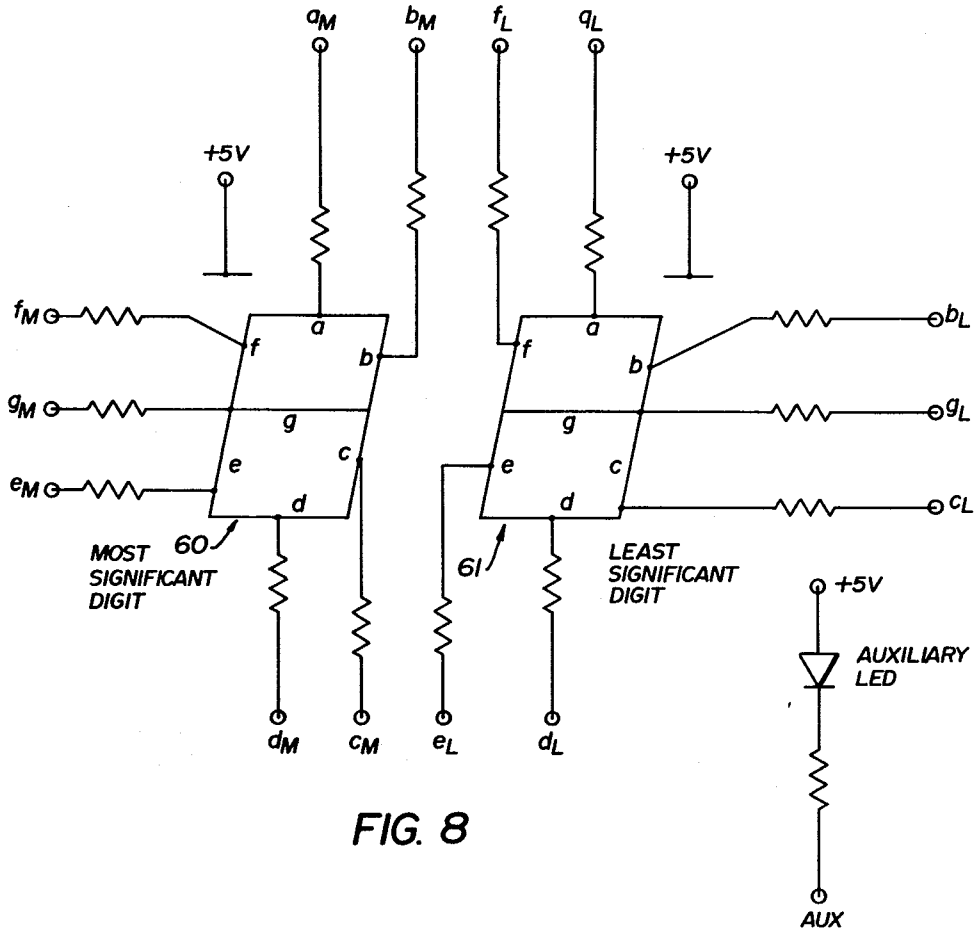
FIG. 8 is a schematic diagram of the connections from FIGS. 4 and 5 of the local digital display.

The previously listed leads of output bus 7 from microcomputer 1 are also applied to a decoder and display driver 58, which preferably is integrated circuit type 4265, available from Intel Corporation. The decoder and display driver 58 is adapted to convert data from the data bus leads $D_0$–$D_3$, under control of the clock and synchronization pulses of the $\phi_1$, $\phi_2$, and sync leads and to convert the signals into parallel coded signals to be applied to the individual segments of a numerical display, such as a light emitting diode (LED) display. The output terminals of the decoder and display driver are shown as $W_0$–$W_3$, $X_0$–$X_3$, $Y_0$–$Y_3$, and $Z_0$–$Z_3$. These output terminals are connected to the input of inverter amplifiers 59 to output leads $a_M$, $b_M$, $c_M$, $d_M$, $a_L$, $b_L$, $c_L$, $d_L$, $e_M$, $f_M$, $g_M$, AUX, $e_L$, $f_L$, $g_L$, and enable. These leads are connected to the individual leads of the corresponding LED segments 60 (forming the most significant digit) and 61 (forming the least significant digit), see FIG. 8.

With the connections shown, the signals on the data bus corresponding to the crosspoint which had been closed in the external switch matrix causes immediate display of the number corresponding to the crosspoint by the LED display. This display is preferably located adjacent the game operator, such as part of the Bingo game table itself.

It should be noted that binary counter 53 and flip flop 55 as well as AND gate 54 are connected in a manner such that only 8 clock pulses are generated from the sync lead per output eight digit character.

Figure 9:
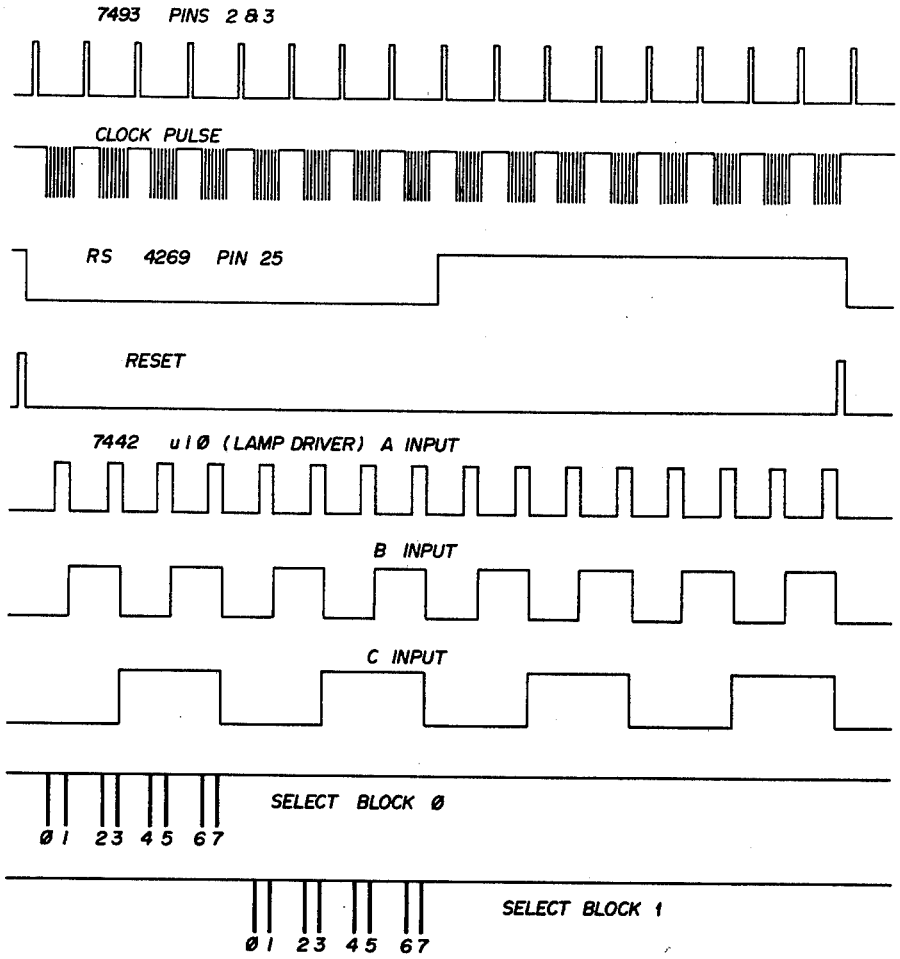
FIG. 9 is a waveform diagram showing the signals at various locations in the input and output interface, controlling, decoding and lamp driving portions of the invention.

Each of the scanning output terminals $S_0$–$S_7$ of input-output peripheral 37 is connected through a corresponding diode $D_1$–$D_8$ to a resistor to the base of transistor 61. Accordingly, each scan pulse is passed through transistor 61; its collector output is applied to the reset inputs of counter 53 and flip flop 55. As a result, the scanning pulse train from transistor 61 causes reseting of the counter 53 and flip flop 55, which act as multiplexer address counters, and are accordingly reset. A reset pulse is also generated as described earlier derived from terminal $S_7$ of peripheral 37, through diode $D_1$, AND gate 46, to the reset lead of the cable 15, which synchronizes the output serial data to the first character. The timing for the reset pulse relative to the signal on the RS output of peripheral 37, the clock pulses and the reset pulses of the counter 53 are shown in FIG. 9.

As noted earlier, cable 15 leads to the indicator circuit board, and since it is comprised of only 4 wires, can be both lengthy and flexed around short radius corners.

Figure 6:
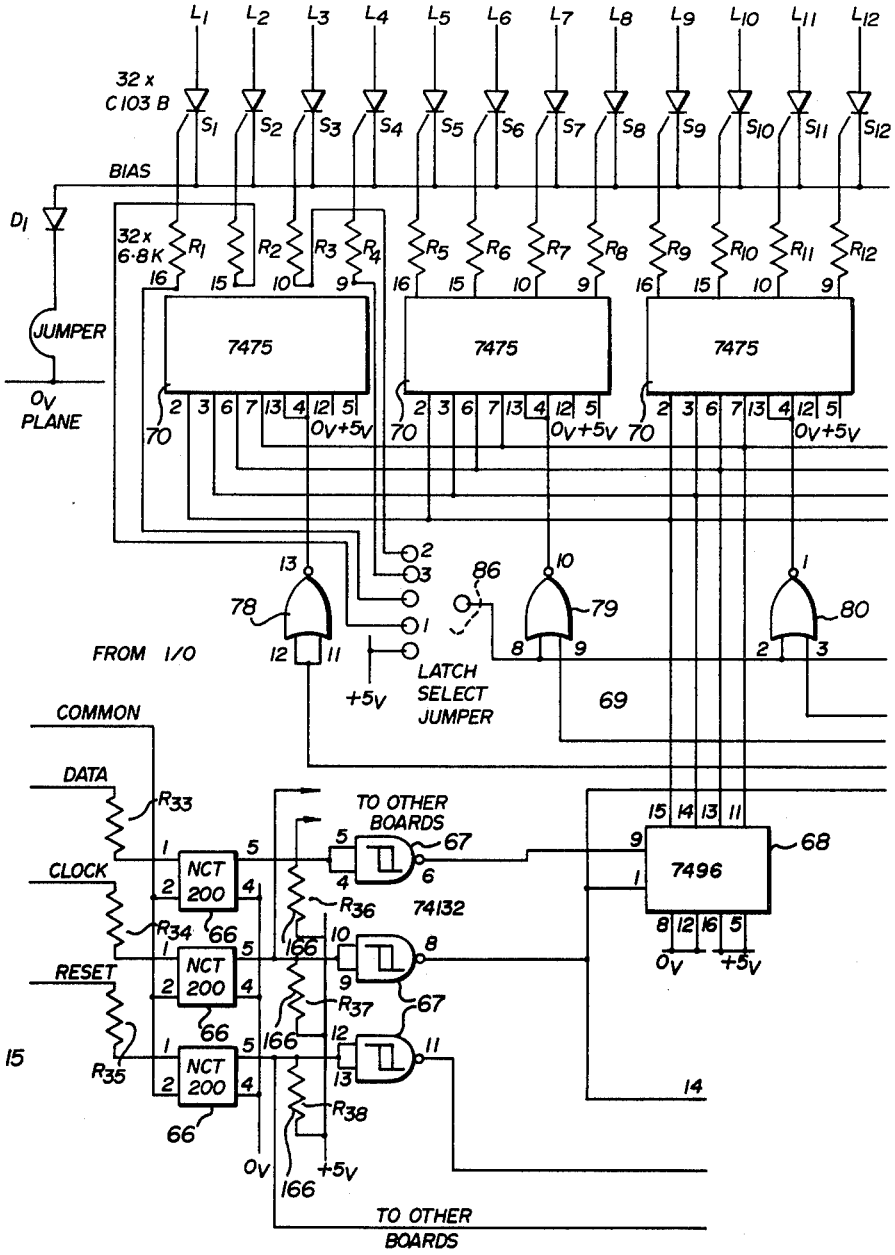
Figure 7A:
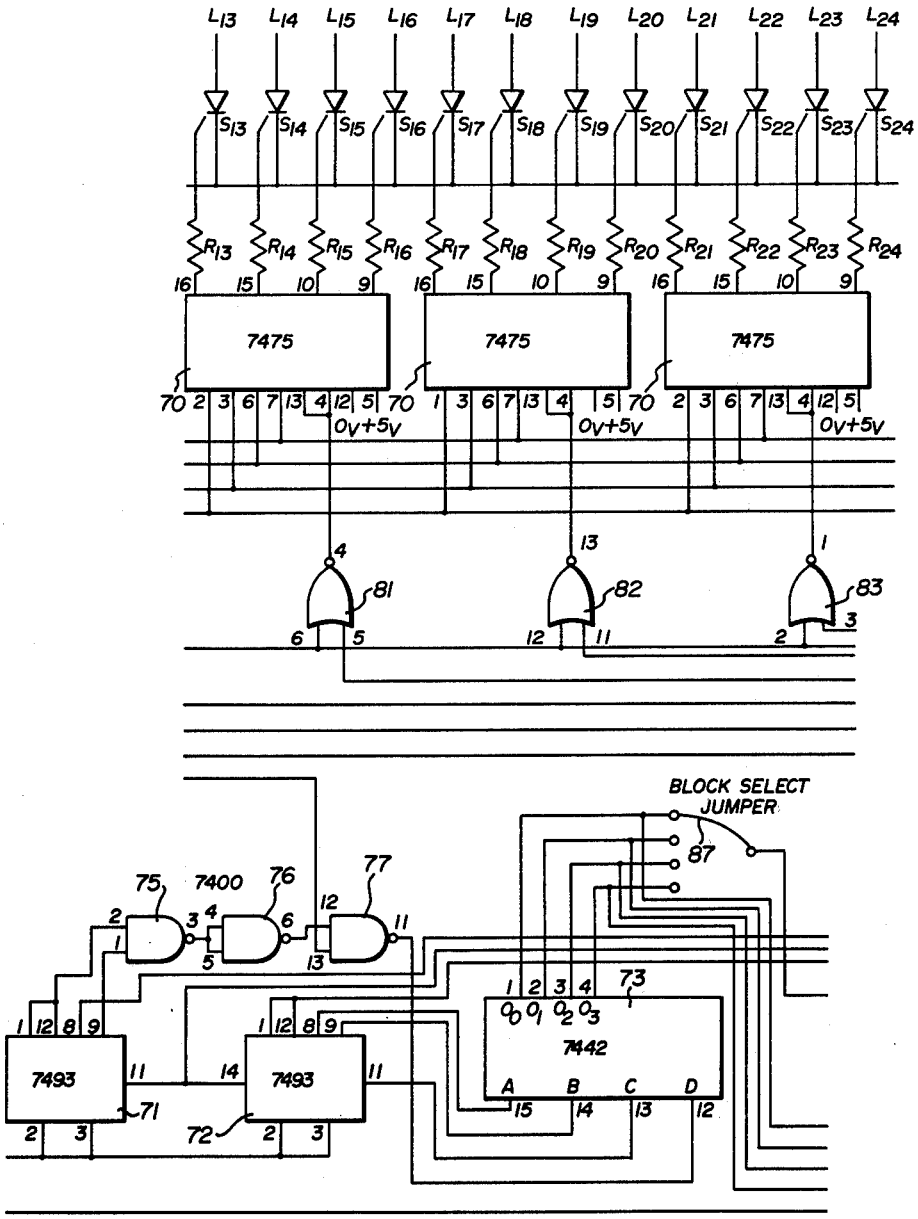
Figure 7B:
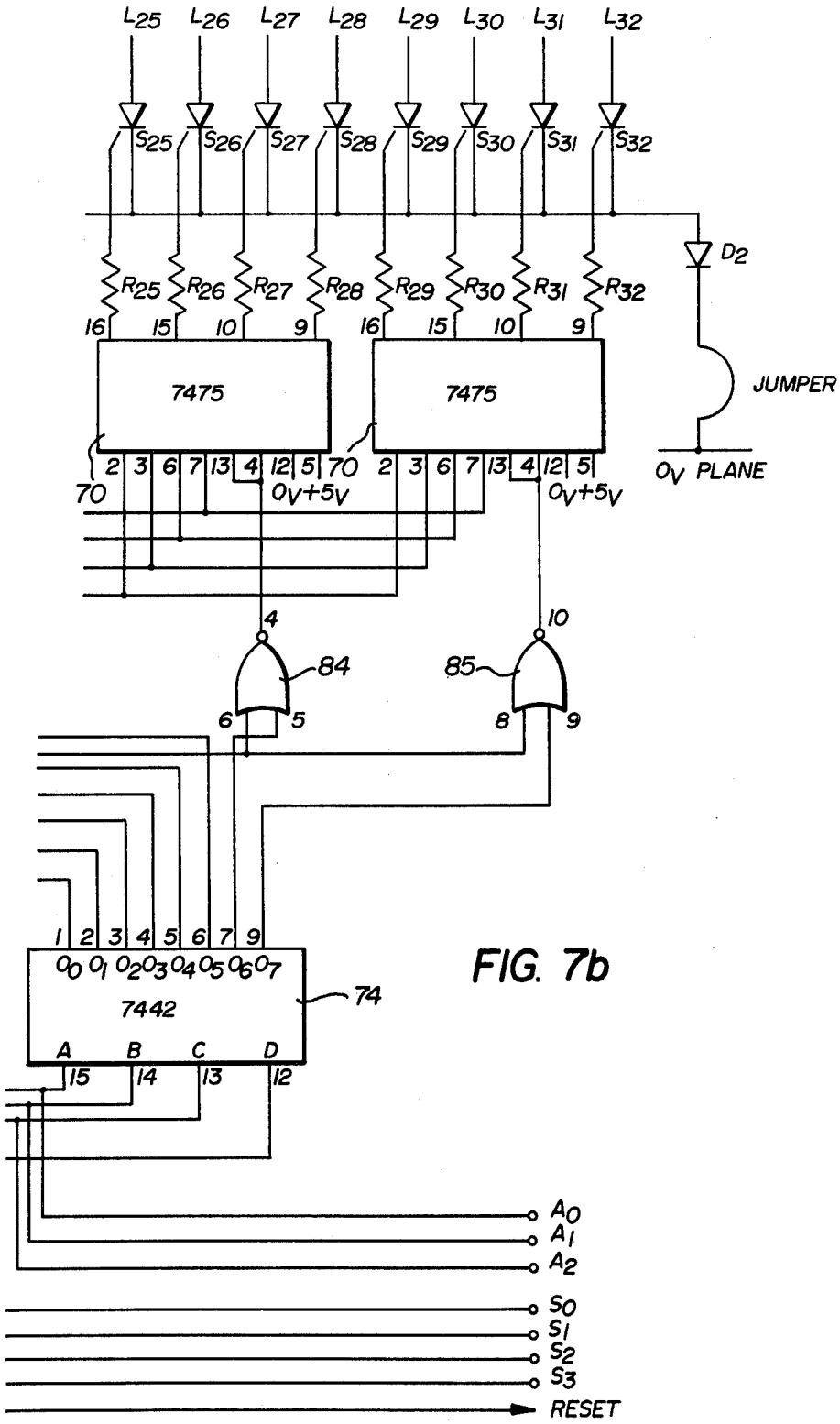

Turning now to FIGS. 6 and 7, the end of cable 15 is shown. The data, clock, and reset leads are connected individually through small valued resistors 65 to the input of individual optical isolators 66. The return lead of the input of all of the optical isolators are connected together and to the common lead of cable 15. At the originating end of cable 15, the common lead is connected to a source of potential +V (see FIGS. 4 and 5). Accordingly, as each LED driver amplifier 48 on the Data, Clock and Reset leads is switched on, a circuit is completed causing current to pass through the corresponding optical isolator 66. The output transistor within the corresponding isolator is turned on, causing its collector to pull the voltage from a high to a low potential state. When the amplifier 48 are switched off, open circuiting the aforenoted circuit, the collector voltage goes back to the high state. The individual output leads of optical isolators 66 are connected to the resistors 166 and to the individual inputs of Schmitt triggers 67.

The function of the optical isolators is to convert the current loop data transfer pulses into voltage pulses, and to provide electrical isolation between the microcomputer system and the light driver electronics. The current loop data transfer preferably uses currents in excess of 20 mA and provides excellent immunity from interference and general stray effects. The relatively slow response of the isolator also minimizes cable ringing effects. Electrical isolation is required where the display lights are directly driven from a 115 V mains supply. The function of the Schmitt triggers 67 is to reconstruct each pulse into square wave form in order that these pulses reliably operate the following electronic devices.

The output of Schmitt trigger 67 to which the data pulses are applied is connected to a serial-to-parallel decoder 68, which is preferably in the form of a 4 bit capacity shift register, such as type 7496 available from Fairchild Corporation.

The output of Schmitt trigger 67 to which the clock pulses are applied is also connected to the clock input of the aforenoted shift register 68. Since the shaft register has capacity of four bits, every four clock pulses on its output leads 69 contain a four bit binary word. These words are applied via output leads 69 to the input of latches 70. Preferably the latches are type 7475, available from Fairchild Corporation.

Each four bit binary word designates one out of four of the latch circuits within latches 70 to lock up to an operative level. Each latch circuit is connected through a resistor $R_1$–$R_{32}$ to the gate of an individual one of silicon controlled rectifiers $S_1$–$S_{32}$. Each silicon controlled rectifier is connected from a 0 voltage plane through an individual lamp $L_1$–$L_{32}$ (not shown) to a lamp current supply.

As each latch requires a 1 out of 4 operate instruction with each four bit binary word, it is necessary to address the particular latch which is to release its information and activate the appropriate silicon controlled rectifier to cause illumination of the appropriate light bulb on the display.

The clock output of Schmitt trigger 67 is applied to the input of counter 71. One output of counter 71 is connected to the input of counter 72. The outputs of counter 71 and 72 are connected to decoders 73 and 74, both directly and serially through AND gates 75, 76, and 77 as shown.

The reset signal from the reset lead after passing through its corresponding optical isolator and Schmitt trigger is applied to the reset input of both of counters 71 and 72.

Decoder 74 decodes the latch addresses for the latches 70, whereas decoder 73 determines whether the address is designated for the shown latches.

To provide a full complement of 75 or 90 numbers, additional circuits will be connected to cable 15, which circuits are designated by a different block designator. The block select jumper connects decoder 74 to the appropriate output of decoder 73 to ensure that the present display operate circuitry is the one designated for operation. Since the address decoding is established from the clock pulses, the block select jumper merely enables decoder 74 at an appropriate time for each data word received from the cable. It is preferred that the data signal should consist of 128 bits broken into four 32 bit blocks. Block select jumper therefore causes decoder 74 to designate the appropriate address during one block of the four 32 bit blocks in each data word signal.

The output leads of decoder 74 are individually connected to one of the inputs of each of respective NOR gates 78–85. The output of each of the NOR gates is individually connected to the enable input of respective corresponding latches 70. It should be noted that there are two ways of addressing latches 70 shown. In one case NOR gate 78 addresses its corresponding latch, as do the remaining NOR gates address latches 79–85. One input of each of NOR gates 79–85 is individually connected to corresponding individual outputs of decoder 74. The other inputs of NOR gates 79–85 are connected together and to a source of inhibiting voltage. Each of the latches 78–85 enables its corresponding latch 70 when an appropriate output is obtained from decoder 74.

In the second way of addressing, instead of being connected via the latch select jumper 86 to a source of inhibiting voltage, the second input of each of the NOR gates 79–85 can be connected to one of a group of 4 leads connected to the output of the latch to which NOR gate 78 is connected. Accordingly the data word signal which is decoded by decoder 68 appears at the output of latch 70 to which NOR gate 78 is connected determines the time at which the remaining NOR gates 79–85 are enabled. Accordingly there is a substantial expansion of the capability of the apparatus to respond to the data signal, which is in effect an increasing of the effective data storage of the input-output peripheral 37.

With the latch select jumper 86 connected to any of the four outputs of the latch 70 to which NOR gate 78 is connected, NOR gate 78 is first activated with a particular word signal decoded in decoder 68. Latch 70 performs decoding, causing, for instance, one of its output terminals to be at the proper operate level for one of the input leads of NOR gates 79–85. A second address is thus formed and not only is an address of decoder 74 required to activate one of NOR gates 79–85, but also an address resulting from the four bit binary word decoded via latch 70 which is activated through NOR gate 78. Successive four bit binary words can therefore be used to activate various latches in succession as a result of an effective expansion of the addressing.

The lamp driver circuit board which is to respond to the data of the four 32 bit blocks in the 128 bit data stream is determined by the block select jumper 87 connected to the appropriate output on decoder 73, as described earlier. Each lamp driver board has its block select jumper connected to a different output terminal of decoder 73.

In a Bingo game which utilizes either 75 or 90 numbers, it should be noted that three of the circuits just described are used, although there is capacity for four. In a three lamp-driver circuit system, there is capability for $3\times32$ 96 lamps. In a 90 number system, 90 of the 96 lamps are used to illuminate the numbers; the remaining six can remain disconnected (distributed as two silicon controlled rectifiers not connected per lamp driver board, preferably), or they can be used to illuminate designator words other than the numbers, such as whether the game is normal, a special etc. In a 75 number system, there can be 30 silicon controlled rectifier lamp drivers operated on two lamp driver circuit boards, and 15 on a third.

In operation, data signals are received from the data lead of cable 15 and are translated in the corresponding optical isolator 66. The output is restored to proper pulse form with a short enough rise time to reliably operate the following logic, in Schmitt trigger 67. The serial data is converted by decoder 68 to four bit words which appear on output leads 69. The decoder 68, being a shift register, is operated from the clock pulses which are received from the clock lead passed through Schmitt trigger 67 in a similar manner as the data signals. The four bit words which are designated for the present lamp driver circuit appear as a sequence of 8 four bit bytes comprising a 32 bit block of data, while binary data designated for other lamp driver boards for illuminating the same display are contained in successive four bit, eight byte data signals which follow in three successive blocks.

At the beginning of each 128 bit block of data, a reset pulse is present on the reset lead. After being translated by the corresponding optical isolator 66 and Schmitt trigger 67, the reset pulse is applied to counters 71 and 72 which drive decoders 73 and 74. As a result an output signal appears on one of the four outputs of decoder 73, which enables decoder 74 as a result of its block select jumper being connected to one of the four decoder 73 output terminals. Since counters 71 and 72 have the clock pulses as inputs, and the outputs thereof are also connected to decoder 74, decoder 74 is enabled at an input terminal A at the clock pulse frequency, at an input terminal B by $\frac{1}{2}$ the clock frequency, and an input termical C at $\frac{1}{4}$ the clock frequency. The block select enables the decoder 74 at $\frac{1}{2}$ frequency of the signal at terminal C and the result is an enabling of output terminals $O_0$–$O_7$ sequentially during the block select enabling period. Of course while the enabling period is for one complete period of the signal (both high and low level) of the pulse at the C terminal of decoder 74, it will not be enabled again until the appropriate block of signal activates the terminal to which the block direct jumper is connected, that is every fourth block of 32 bytes.

With the output terminals $O_0$–$O_7$ sequentially activated, each of NOR gates 78–85 is sequentially activated (assuming latch select jumper 86 is connected to an inhibit voltage level). Accordingly each latch 70 is sequentially enabled, and, when enabled, latches up with the parallel four bit signal applied to its respective input at the particular time it is activated from output leads 69 of decoder 68. As a result silicon controlled rectifiers $S_1$–$S_{32}$ are activated and remain on until latch 70 receives a changed input signal, is enabled, and changes its latch status. Lamps connected to terminals $L_1$–$L_{32}$ of the silicon controlled rectifiers are thereby caused to operate according to the data on cable 16, at the particular appropriate time.

Other lamp driver circuits operate in a similar manner, except that the block select jumper is connected to a different output terminal of decoder 73. Hence it is activated according to its designated data, and the remaining lamps on the 75 or 90 display board are lit.

It should be noted that since the appropriate address decoding is performed by counters 71 and 72 and decoder 73, these components and NAND gates 75, 76, and 77 need not be performed in successive boards. The address decoding terminals $A_0$–$A_2$ and $S_0$–$S_3$ can be connected to other boards, directly to their corresponding decoders 74. In this case the decoder 74 terminal D of the immediately following display circuit has its jumper connected to, for instance, lead $S_1$, rather than as in the present display circuit, to $S_0$.

It was noted earlier that the input-output peripheral 37 contains a RAM. This RAM is, in the preferred type 4269 a circulating buffer having registers for storing 16 bytes by four bits each, providing a capacity of 64 bits per register, or 128 bits in total. FIG. 10 depicts a layout of the preferred form of storage within the registers, designated as A register and B register. The B register addresses of each four bit byte is shown as the left hand column, and the addresses for each four bit byte of the A register is shown in the right hand column. A bit stored at each of the locations designated by a square within the A or B register designates that a corresponding lamp designated by the number of the storage location in FIG. 10 is to be lit. For instance, if column 2 of the bit register having row address 54 contains a binary "1", lamp number 33 is to be lit. Accordingly the program signals stored within the microcomputer cause a binary bit to be stored at location 33 when the crosspoint switch number 33 has been closed and this has been sensed by a scanned pulse on one of lead $S_0$–$S_7$, and has been received on one of leads $R_0$–$R_7$ by peripheral 33, also under control of the microcomputer. Upon sensing of the closure of crosspoint switch 33, a bit is deposited at location 33 in the B register of the RAM shown in FIG. 10.

When the RAM is read, a bit at location 33 is recognized, and the local light emitting diode display immediately displays numeral 33 in the manner described earlier. In addition, the operation signals of the microcomputer cause the input-output peripheral 37 to output numeral 33 of the RAM B register on the display terminals $B_0$–$B_3$, $A_0$–$A_3$. This signal is changed to serial form within binary to serial multiplexer 49, and is outputted as data at the appropriate time designated by the RAM scan time when the memory location is accessed. This, of course, is in synchronism with the clock pulses which are applied outputted to the clock lead of cable 15. As described earlier, a reset pulse at the beginning of each second scan cycle is also provided on the reset lead.

The numeral 33 in data signal form appearing at the appropriate time in the RAM scan sequence is decoded in the lamp driver cirucit and applied to latches 70. The clock pulses are decoded as described earlier into an address, and the appropriate latch is enable at the proper time for numeral 33, in 4 bit binary form applied to the input of latches, to activate the gate of a single silicon controlled rectifier, causing operation of a single lamp as described earlier.

The operation signals of the microcomputer are adapted to cause numeral 33 to flash on and off, by successively adding and removing it at particular times from the data signal train exiting the peripheral 37 via terminals $B_0$–$B_3$ and $A_0$–$A_3$. A further number crosspoint being closed causes the operation signals to keep numeral 33 illuminated steadily, and the next crosspoint will cause an illuminated number to flash, after its number is stored in the RAM at the appropriate location as described.

While the above described the function of the apparatus to display a numeral, variations of the above result as the program signals are varied; yet the illumination sequence is as outlined. Accordingly the description below is directed to the operation or program signals portion of the invention which are processed and translated by the apparatus.

Appendix 1 is comprised of a listing of the mnemonics which constitute the substance of the preferred program required for the system, assuming that the components described earlier include the Intel type 4040 microprocessor, from which the machine language program can be written. The mnemonics are assumed to be well known to a person skilled in the art, and a listing thereof and their function as well as their machine language equivalent is available from the aforenoted Intel Corporation. However to aid in understanding of the specific portions of the programs, each group of a distinguishable series of mnemonics are headed by a descriptive title which notes the function of the sequence of mnemonics which follows. As the titles are clear and are intended to be descriptive of the function of the signals stored which correspond to the mnemonic listing, no further description thereof is deemed necessary, since simply following the sequence of titles will provide sufficient explanation to a person skilled in the art to program the microcomputer sufficiently to carry out the invention.

For instance, turning to page 5 of the Appendix, the heading START OF MAIN ROUTINE and the setting up of the modes, timer periods, etc. becomes clear.

However, to orient the reader further to the functions of the signals provided by the mnemonics, a logic flow chart from which the sequence of the mnemonics was derived will be described by reference to the MAIN ROUTINE flow chart, FIGS. 14 and 15 which are to be read together, the MAIN INTERRUPT flow chart, FIGS. 16 and 17 which are placed together, the INTERRUPT ROUTINES, in FIG. 18, the SYSTEM SUBROUTINES, FIGS. 19 and 20 which are placed together, and the PATTERN SUBROUTINE, in FIGS. 21 and 22 which are placed together.

In respect of the functions performed by the system, as was noted earlier selected switches of the external crosspoint switch matrix are operated in sequence upon the random selection of the numbers carried on Ping Pong balls contained within a conventional Bingo blower. Once a particular selection has been made, the most recently selected number on the display board is flashed repeatedly, once per second preferably, while previous selections remain illuminated. The operation of a digital display adjacent or on the housing of the switch matrix can be used to accurately time the calling of the selected numbers by the caller. After each timed period is over, the local digital display is caused to flash on and off indicating that another selection is required. The preferred programmed form of the timer can be speeded up or slowed down in one second increments.

A special feature of the system provides a pattern display (FIG. 13) which operate to indicate a Bingo pattern to be used for a particular game. The pattern can also be rotated by 90 degrees from whatever is displayed by closing a crosspoint control switch. The system also has the capability to test itself.

Turning now to FIGS. 14 and 15, the main routine begins by programing the input-output peripheral 37 (described by reference to its component number 4269) to a predetermined operating mode described in the first block, as is the decode and display driver 58 (referred to as component type 4265). The main routine in mnemonic form starts on page 5 of Appendix 1.

The flow chart then describes the function of the signals required to monitor the crosspoint switch closure addresses generated in the interrupt handler routine. The switch closure can be for a number selection, or for a control function. If the switch closure is for a number selection, the routine checks to see if this number has already been selected. If it is a new selection the address is passed back to the interrupt handler routine. If the switch closure is a control switch, it is checked for either a CANCEL indication or for a START indication.

If the control switch is a CANCEL indication, the current selection address is made void (i.e., an address is given which causes no computer action) and the RAM storage in the input-output peripheral 37 is cleared at that address.

It the switch closure is a "start" control indication, the entire RAM storage in the input-output peripheral 37 is cleared and a void current selection address is set.

Turning now to FIGS. 16, 17 and 18, the interrupt routine and subroutine flow charts are given. The interrupt handler begins when a system interrupt is generated upon detection of a switch closure by the input-output peripheral 37. The purpose of this routine is to scan the two switch matrix blocks to determine which switch closure has generated the interrupt.

If the real time microcomputer time switch from the clock circuit had generated the interrupt, then the interrupt timer is advanced. When the interrupt timer overflows the following events occur:

(1) the interrupt timer is reloaded;

(2) the on/off toggle flag is reversed (toggled);

(3) the binary bit which had been stored at the current selection address in the input-output peripheral RAM store is set to a 1 if the toggle switch is on, and is set to a 0 if the toggle switch is off; and (4) the system timer is decremented until it reaches a value of 0.

Figure 11:
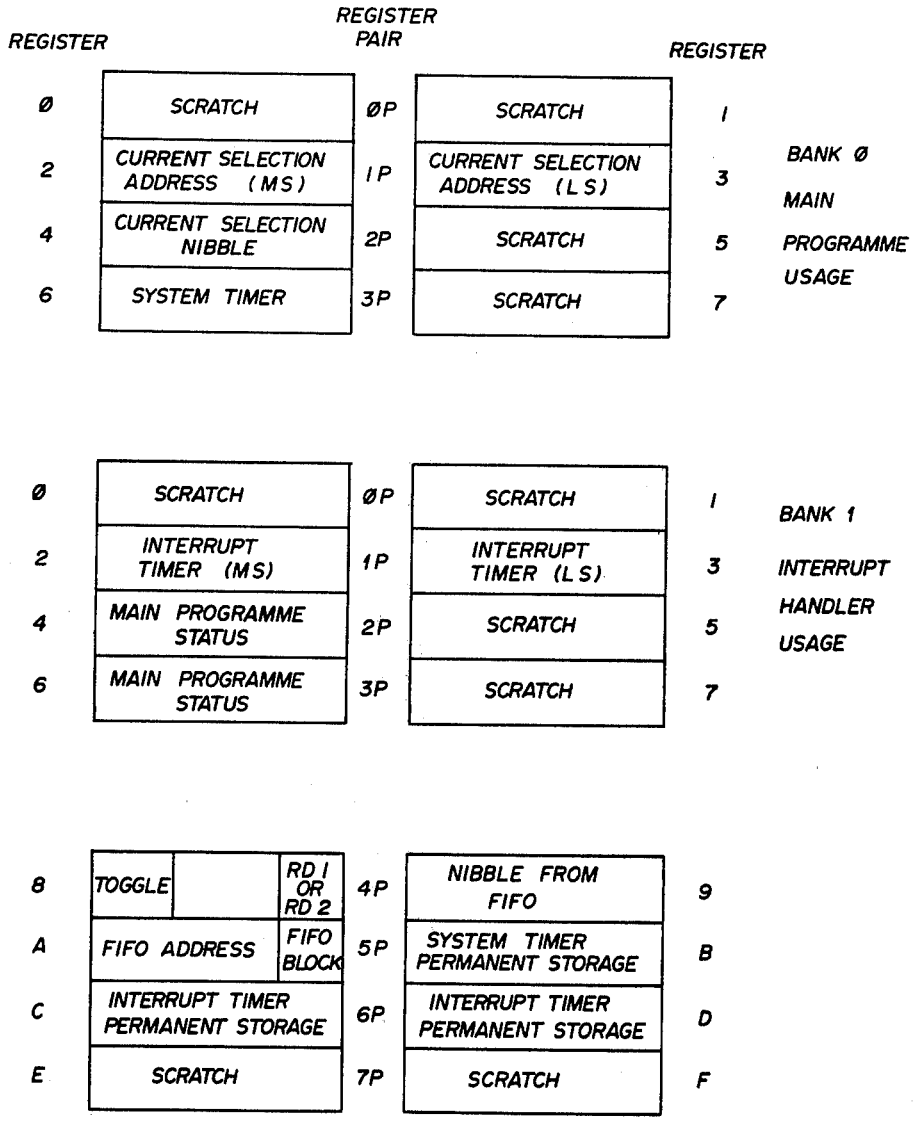
FIG. 11 is a plan of the contents of the microcomputer registers.

If the interrupt was generated by a number switch, as opposed to a control switch, the routine ignores this and waits to register it when the real time clock interrupt occurs. A switch closure counter is used during the switch scanning periods to detect whether there was no switch closure, one switch closure or more than one switch closure. If no switch closures were detected, no action is taken. If more than one switch closures were detected, the nibble of information of the switch closure position is set to "void" (i.e. all 1's). If one switch closure was detected, the switch closure position is placed in various registers as noted below. See FIG. 11 for a designation of the assignments of the scratch memory register in the microprocessor. Also see FIG. 12 for a designation of the storage addressed of the crosspoint switch designations in the first in-first out register in the input-output peripheral 37, which, it will be noted, is grouped into Blocks 1 and 2, each of which is grouped into two segments RD1 and RD2.

The switch closure position is placed in the following registers of the microprocessor, for example: the least significant bit of the RD1 or RD2 segment is placed in register 8; the first-in first out (fifo) address and block number is placed in register A; and a nibble pattern from the fifo address is placed in register 9.

The current selection address is stored in registers 2 and 3 of Bank 0 of the memory, and is stored as a direct register control address for the input-output peripheral 37. The nibble to be written to this address is stored in register 4 of Bank 0.

The interrupt routine implements a real time clock by acknowledging only the interrupt caused by the permanent switch closure at the end of block 2 referred to earlier in the description of the hardware. Any other switch closure will generate an interrupt, but the interrupt routine will immediately exit on detecting this. When the permanent switch closure is sensed a register is incremented. When this register reaches zero state (at a frequency of about once every 80 mSecs) a full 2 block scan is performed in order to detect if any switch closures have been made. Since each 8 bit row in the 4269 RAM is being overwritten every 300 microsecs and the "housekeeping" requirements at the start of the interrupt routine are longer than this time, this technique is the manner used to ensure that the switch closure data is not destroyed before being read out. The 2 block scan is implemented by monitoring a change of the column 8, row 8 RAM bit from a one to a zero. This indicates that block 1 has been fully read into the RAM. Block one is now scanned; the timing of this part of the routine is such that the first row is read out before it is overwritten with block 2 data. At the end of the block 1 scan, the routine waits for the column 8, row 8 RAM bit to change from a zero to a one. This indicates that block 2 has been completely written into the RAM, and this is now scanned. A scan counter is used to detect for zero, single or multiple switch closures.

The extension memory part of this interrupt handler routine examines the system timer, and if the timer is 0, turns the digital display on for a toggle flag "on" indication and turns the digital display off for a toggle flag "off" indication. The system timer is reloaded when a new switch closure is detected (see FIG. 15).

A flow chart describing the system subroutine is found in FIGS. 19 and 20. The purpose of these routines is to extend the operation of the system to interface the digital display. The functions of the subroutine are as follows:

(1) to convert the current selection address to a BCD code, to add displacements for the skipped positions and generate the appropriate 7 segment code which is written to the decoder and display driver 58, (2) to check for operation of TEST, SLOW or FST, after closure of an appropriate crosspoint control switch, and to take appropriate action as follows:

(i) TEST: starting at position 0, sequentially illuminate the display numbers up to the highest number, i.e. 75 or 90. The local digital display also is caused to follow the number sequence. At the end of the sequence, the process is repeated after 5 seconds and clearing of the lamps. The START crosspoint switch is continually monitored and upon closure the test sequence is halted and the start procedure is followed.

(ii) SLOW: Increment the permanent system timer to a maximum value of 15 seconds. When the value is loaded into the system timer register, the digital display takes one more second from the time of switch closure to the on/off flashing sequence for each increment.

(iii) FST: Decrement the permanent system timer. This speeds up the timer by one second. The minimum value of this timer is one second.

The pattern subroutine flow chart is shown in FIGS. 21 and 22. These routines are only concerned with the display pattern generator, which is shown with reference to a 75 number system, due to the limitations of the system capacity as described.

The patterns are stored in an extension memory, and are accessed as five stored bytes per pattern. The pattern switch closures are either a requested pattern or one of two pattern control switches: "ROTATE PATTERN" and "TEST PATTERN".

If a pattern is requested, the starting address of the first byte is calculated, and the five bytes are transferred from the extension memory to the last 32 byte block of the RAM storage of the input-output peripheral 37.

Should this option be utilized, a separate pattern light display is utilized, which is separated into quadrants shown in FIG. 13. Groups of lamps within each quadrant are illuminated to display a pattern, which will be the pattern of the numbers to be played by the players of the game.

The light connection diagram is given numerically in FIG. 13. Each quadrant of the board can be considered to be in continguous 6 byte segments of the connected 5 byte pattern. If the pattern is rotated six bytes, then this has the effect of rotating the pattern board by 90 degrees. The six byte rotation is performed in the ROTATE pattern routine.

The TEST PATTERN control switch causes three patterns to be applied to the display board in rapid sequence. The process is repeated until a START switch closure is detected, at which time an interrupt is generated and the systems operate as on the main routine flow chart described earlier.

The system can be given the capability to substitute a random number instead of requiring manual selection of a number using the previously noted crosspoint matrix. The random number generator can be implemented by the microcomputer on the basis of direction from stored control signals comprising a program.

A modulo 16 feedback shift register is implemented, as shown in FIG. 23. Each shift position is numbered or lettered in sequence. An additional function is provided from positions 14 and 15 in position 16, (labelled 216) which has been found to give excellent randomness of the result. A program to obtain the random number in an Intel Corporation 4004 microcomputer is as follows.

| Mnemonic | Function |
|---|---|
| SHF. FIM 6P 125 | /FETCH 125 TO REGISTER PAIR 6 |
| SRC 6P | /SET UP RAM1, REG 3, CHAR D |
| RDM | /GET CHAR D TO ACC. |
| INC 13 | /INCREMENT REGISTER 13 |
| SRC 6P | /SET UP CHAR E |
| CLC | /CLEAR CARRY |
| ADM | /MODULO 16 ADDITION OF CHARACTERS D & E |
| XCH 3 | /EXCHANGE ACCUMULATOR WITH REGISTER 3 |
| FIM 6P 112 | /FETCH 112 TO REGISTER PAIR 6 |
| SRC 6P | /SEND OUT NEXT SHIFT REGISTER ADDRESS |
| RDM | /GET SHIFT REGISTER CHARACTER |
| XCH 3 | /EXCHANGE ACCUMULATOR WITH REGISTER 3 |
| WRM | /WRITE IN PREVIOUS DATA |
| ISZ 13 *−4 | /MOVE UP SHIFT REGISTER |
| XCH 2 | /EXCHANGE ACCUMULATOR WITH REGISTER 2 |
| BBL 0 | /RETURN FROM SHF. RESULT IN REGISTER PAIR 1 |

The subroutine uses register 3 in data RAM #1 of the 4004 system. The register has to be initialized with a pattern other than all zeros. The simplest initialization pattern is to write the character address in as the shift register character itself.

| | |
|---|---|
| FIM 4P 112 | /FETCH 112 TO REGISTER PAIR 4 |
| SRC 4P | /SET UP RAM 1, REG 3, CHAR 0 |
| LD 9 | /TRANSFER REGISTER 9 TO ACCUMULATOR |
| WRM | /WRITE THIS VALUE IN RAM |
| ISZ 9 *−3 | /LOOP AROUND ALL CHARACTERS |

It is believed clear that the present system introduces substantial flexibility in the structure and operation of a Bingo type game. Due to the use of a microprocessor, there is substantial flexibility and thereby improved operation afforded the game operator. Prior to commencement of the game the system can be fully tested at the touch of a button, whereby all lamps are sequentially illuminated. The pattern of the testing is such as to convey a visually exciting display, thus increasing the enjoyment of the players.

Once a number has been called it is displayed to the game operator, and also upon his selection is displayed on the large display board. The most recently selected number flashes, thus providing instant recognizability to players who may not have been devoting their fullest attention to the last called number, thus removing the requirement for them to check all numbers on the display board to find out which has been called last. This obviously reduces player fatigue.

Internal timing, which is variable at the selection of an operator, provides a flashing mode to his local digital display to indicate when the next number should be called. Since the timer accurately paces the game, player restlessness is decreased. Further, upon the designation of a winning game, a "starburst" or other pattern can be displayed on the number display, generally enhancing the excitement of the winning call. Yet, in the case of an erroneous winning call, the previous display can be recalled from memory and displayed for the audience whereupon the game can continue.

In addition, a pattern display can be provided to the audience to show the required winning numerical pattern required for special or "jackpot" games.

In addition to the aforenoted operation advancements, the present invention allows such structural advantages as the use of more than one display board connected in parallel with others and disposed at various locations around the game room. This is particularly an aid in large Bingo halls, particularly in those which are irregularly shaped. Furthermore, the display boards can be located at great distances from the main operation console with significantly increased reliability due to the requirement now of only a four wire cable, rather than the 76 or greater wire cable previously required. The substantially narrower cable can therefore be hidden and can follow a more convenient route around the room than heretofore.

It may become obvious to a person skilled in the art understanding this invention that other modifications and embodiments than those described above can be provided. All are considered within the scope and sphere of the invention as defined in the appended claims.

APPENDIX I

```
*          AUTO MCB  3 PAGE SYSTEM
*
*
*          START OF PAGE ZERO
*
*
           = 000
*
           NOP
           JUN STR
*
*
*          INTERRUPT ROUTINE
*
*          FIRST SAVE MAIN ROUTINE STATUS
*
INT        SB1
           XCH 4
           LCR
           RAL
           XCH 6
*
*          NOW START INTERRUPT HANDLER
*
*          CHECK FOR END OF BLOCK 2
*
           JMS CAD
           RD1
           RAL
           JCN A EN2
*
*          IF BLOCK 2 END, INCREMENT COUNTER
*          AND CHECK FOR SCAN TRIGGER
*
*         COMMENCE SCAN AFTER WAITING FOR
*          END OF BLOCK 1
*
IN1        RD1
           RAL
           JCN 2 IN1
*
*          CHECK FOR TRIGGER BEFORE SCAN
*
           ISZ 3 EN2
*
*          SCAN BLOCK 1
*
*          FIRST CLEAR SWITCH CLOSURE COUNTER
*
```

```
          LDM 0
          XCH 7
*
*         NOW SCAN
*
          JMS BLK
*
*         NEXT SCAN BLOCK 2
*
*         FIRST WAIT FOR END OF BLOCK 2
*
          JMS CAD
IN3       RD1
          RAL
          JCN A IN3
*
*         NOW SCAN
*
          JMS BLK
*
*         END OF BLOCK SCANS
*
*         CHECK SWITCH CLOSURES
*
          LOD 7
          KBP
*
*         JUMP IF NO SWITCH CLOSURES
*
          JCN C I12
          LDM F
          XCH 9
          JUN EN1
*
*         JUMP IF SINGLE SWITCH CLOSURE
*
I12       RAL
          JCN A IN5
*
*         SET NIBBLE FLAG
*
          RAR
          XCH 9
          JUN EN1
*
*         SET BLOCK FLAG FOR SINGLE SWITCH CLOSURE
*
IN5       LDM 1
          AN7
          XCH 5
          XCH A
          OR5
          XCH A
*
*         INCREMEMT INTERRUPT TIMER LOW ORDER NIBBLE
*         TO TAKE ACCOUNT OF TIME TO SERVICE INTERRUPT
*
```

```
EN1     INC 3
*
*       CHECK HIGH ORDER NIBBLE
*
        ISZ 2 EN2
*
*       RELOAD INTERRUPT TIMER AND
*       SERVICE SYSTEM TIMER
*
        LOD D
        XCH 3
        LOD C
        XCH 2
*
*       HAVE TO CHECK FOR ON TOGGLE FIRST
*
        SB0
        LOD 8
        RAL
        JCN A IN7
*
        XCH 6
        JCN 4 IN6
        DAC
IN6     XCH 6
*
*       JUMP TO EXTENSION MEMORY
*
IN7     JCN 1 I13
        JMS IEX
*
*       FLASH CURRENT SELECTION
*
I13     LOD 4
        SRC 1P
        SB1
        XCH 5
        LOD 5
        CMA
        XCH 7
*
        LOD 8
        RAL
        RD3
        OR5
        JCN 2 IN8
        AN7
IN8     WMP
*
*       TOGGLE ON/OFF FLAG
*
IN9     XCH 8
        RAL
        CMC
        RAR
        XCH 8
*
```

```
*          WRAP UP
*
EN2        JMS CAD
           WR2
           XCH 6
           RAR
           DCL
           XCH 4
           BBS
*
*          SUBROUTINE TO SET UP CONTROL
*          SWITCH ADDRESS FOR 4269
*
CAD        FIM OP 4E
           SRC OP
           BBL 0
*
*          SUBROUTINE TO SCAN A BLOCK
*          OF 8 X 7 SWITCHES
*
BLK        LOD 7
           CLC
           RAL
           XCH 7
*
           FIM OP 40
BL1        SRC OP
*
*          SAMPLE LOW ORDER NIBBLE
*
           RD2
*
*          SKIP IF NO CLOSURE
*
           JCN 4 BL2
*
           XCH 5
           LDM 1
           JMS MON
*
*          SAMPLE HIGH ORDER NIBBLE
*
BL2        RD1
*
*          SKIP IF NO CLOSURE
*
           JCN 4 BL3
*
           XCH 5
           LDM 0
           JMS MON
*
*          INCREMENT ROW ADDRESS AND
*          CHECK FOR COMPLETION
*
```

```
BL3     INC 1
        INC 1
        LOD 1
        IAC
        IAC
        JCN C BL1
*
*
        BBL 0
*
*
*       MONITOR ROUTINE FOR SWITCH CLOSURES
*
MON     XCH 5
        XCH 9
*
*       MASK OUT RD1/RD2 FLAG
*
        LOD 8
        RAR
        CLC
        RAL
*
*       NOW PUT IN CURRENT STATUS
*
        OR5
        XCH 8
*
        LOD 1
        XCH A
*
*       CHANGE SWITCH CLOSURE COUNTER STATUS
*
EN2     LOD 9
        KBP
        RAL
        LOD 7
        JCN A MN3
        STC
        RAL
MN3     STC
        RAL
        XCH 7
*
        BBL 0
*
*
*
*       START OF MAIN ROUTINE
*
*       FIRST SET UP 4269 TO FOLLOWING STATUS
*
*       INDIVIDUAL SCANNED DISPLAY:  16 DIGITS
*       ON A & B REGISTERS.
```

```
*
*          SCANNED SWITCH SENSOR MATRIX
*
*
STR        FIM OP 40
           SRC OP
           LDM 0
           WRO
           WR1
           WR2
*
*          SET UP 4265 TO OUTPUT MODE
*
           FIM OP 80
           SRC OP
           LDM 4
           WMP
*
*          SET INTERRUPT TIMER TO 0.5 SECONDS
*
           FIM 6P A5
*
*          SET SYSTEM TIMER TO 10 SECONDS
*
           LDM A
           XCH B
*
*          SET CURRENT SELECTION TO INHIBIT
*
           FIM 1P C0
*
*          ENABLE INTERRUPTS AND START CHECKING INITIAL
*          VALID ADDRESS
*
*
*          FIRST CHECK VALID ADDRESS
*
COM        DIN
           LOD 9
           XCH 7
           EIN
           LOD 7
           IAC
           JCN 4 COM
*
*          TURN OFF INTERRUPTS
*
           DIN
*
*          JUMP TO EXTENSION MEMORY
*
           JCN 1 CM7
           JMS CSW
*
```

```
*          CHECK FOR CANCEL OR START
*
CM7        LDM 3
           CLC
           ADD A
           JCN C CM4
*
CM9        LOD 8
           RAR
           JCN 2 CM6
           LOD 7
           RAL
           RAL
           JCN A CM4
*
*          RESTART GAME: CLEAR 4269
*
RST        FIM OP 40
           SRC OP
           LDM 0
           WR1
           FIM 1P C0
*
*          TURN ON INTERRUPTS AND BACK TO START
*
           EIN
*
           JUN COM
*
*          CHECK CANCEL
*
CM6        LOD 7
           RAL
           JCN A CM4
*
*          CANCEL CURRENT SELECTION
*
*          FIRST WAIT FOR TOGGLE OFF
*
           EIN
TOF        LOD 8
           RAL
           JCN 2 TOF
*
           FIM 1P C0
*
           JUN COM
*
*          GET CONTENTS OF ADDRESS
*
*          FIRST GET ADDRESS
*
CM4        LOD A
           XCH 1
```

```
            LOD 8
            RAR
            LDM 2
            RAL
            XCH 0
*
*           TURN ON INTERRUPTS
*
            EIN
*
TON         LOD 8
            RAL
            JCN A TON
*
            SRC OP
            RD3
*
*           CHECK IF ALREADY WRITTEN TO
*
            AN7
            JCN 4 COM
*
*           WRITE NEW SELECTION
*
            LOD 7
            XCH 4
            LOD 1
            XCH 3
            LOD 0
            XCH 2
*
*           JUMP TO EXTENSION MEMORY
*
            JCN 1 CM8
            JMS BIN
*
*           REWRITE SYSTEM TIMER
*
CM8         LOD B
            XCH 6
*
            JUN COM
*
*
*
*
*************************************************
*
*           PAGE 1 JUMP ADDRESS
*
*           = 100
*
*
*           WRITE TO DISPLAY
*
```

```
*          ROUTINE TO GET THE BCD VALUE OF 4269
*          ADDRESS IN BANK 0 REGISTER PAIR 7
*
*          FIND BINARY NUMBER FROM NIBBLE PATTERN
*
BIN        LOD 7
           KBP
           XCH F
*
*          ADD 4 IF NECESSARY
*
           LOD 0
           RAR
           JCN 2 BN3
           LDM 4
           ADD F
           XCH F
*
*          ADD 8 IF NECESSARY
*
BN3        LOD 1
           CLC
           RAR
           XCH E
           JCN A BN4
           CLC
           LDM 8
           ADD F
           XCH F
*
*          PREVENT WRITING IF CONTROL SWITCH
*
           JCN C BN4
*
           BBL 1
*
*          CORRECT FOR DISPLACEMENTS
*
BN4        CLC
           LOD F
           SUB F
           XCH F
           CMC
           LDM 0
           XCH E
           SUB E
           XCH E
*
*          LEAVE
*
*          ROUTINE TO CONVERT 7P BINARY
*          TO BCD AND LEAVE RESULT IN 7P
*
BCD        CLB
           XCH E
```

```
          XCH 5
          LDM A
          XCH F
*
*         BCD COUNTER IN REG. E, MSD IN REG. 5,
*         A IN REG. F & LSD IN ACCUMULATOR
*
*         NOW SUBTRACT A FROM LSD
*
BC3       SUB F
*
*         CHECK FOR BORROW
*
          JCN 2 BC1
*
          XCH 5
          DAC
          XCH 5
*
*         LSD IN ACC., MSD-1 IN REG. 5
*
BC1       JCN A BC2
*
*         JUMP IF ANSWER FOUND
*
          INC E
          CLC
          JUN BC3
*
*         ADD BACK 10, PUT LSD IN REG.F AND EXIT
*
BC2       ADD F
          XCH F
*
*         ROUTINE TO WRITE 7 SEGMENT CODE TO
*         DISPLAY.  BCD IN 7P
*
WRT       FIM OP 80
          SRC OP
*
*         4265 ADDRESSED, NOW GET CODE TO REG. PAIR 0
*
*         FIRST CHECK FOR LEADING ZERO
*
          FIM OP 00
          LOD E
          JCN 4 WT1
          LDM F
          XCH 0
          CLC
          LDM 6
          ADD E
          XCH 1
*
*         CODE ADDRESS IN OP, NOW GET CODE
*
```

```
          FIN OP
*
*         WRITE CODE TO MSD
*
WT1       LOD 1
          WR0
          LOD 0
          WR2
*
*         SAME PROCEDURE FOR LSD
*
WT3       LDM F
          XCH 0
          CLC
          LDM 6
          ADD F
          XCH 1
*
          FIN OP
*
          LOD 1
          WR1
          LOD 0
          WR3
*
          BBL 0
*
*         CHECK FOR CONTROL SWITCH
*         (SLOW, FAST OR TEST)
*
CSW       LDM 3
          ADD A
          JCN 4 CS1
*
*         JUMP TO EXTENSION MEMORY 2
*
CS2       JUN CSX     (for 1 page memory extension
*                      this becomes
CS1       LOD 8                          CS2     NOP
          RAR                                    BBL 0 )
          JCN 2 CS2
*
          LOD 7
          RAR
          JCN 2 FST
*
          RAR
          JCN 2 SLW
*
          LOD 7
          RAL
          JCN A CS2
*
*         TEST ROUTINE
```

```
*
*          PUT STARTING NUMBER IN SRC ADDRESS
*          AND BCD CODE IN 7P
*
TST        FIM 1P 50
           LDM 1
           XCH 4
           FIM 7P 01
*
*          SPEED UP TIMER
*
           FIM 6P F5
*
*          START TEST LOOP
*
           EIN
*
*          FIRST STOP SYSTEM TIMER FLAG
*
TS1        LDM F
           XCH 6
*
*          WRITE OUT TO DISPLAY
*
           JMS WRT
*
*          TURN ON DISPLAY
*
           LDM F
           JMS BSR
*
*          WAIT FOR TRANSITION FROM TOGGLE OFF TO
*          TOGGLE ON, THIS ESTABLISHES THAT THE
*          PREVIOUS DATA WAS WRITTEN
*
TS3        LOD 8
           RAL
           JCN 2 TS3
TS2        LOD 8
           RAL
           JCN A TS2
*
*          UPDATE BCD DATA
*
           CLB
           XCH F
           IAC
           DAA
           XCH F
           ADD E
           XCH E
*
*          UPDATE NIBBLE
*
TS7        CLC
           LOD 4
           RAL
*
```

```
*          CHECK FOR OVERFLOW
*
           JCN A TS4
*
*          OVERFLOW ROUTINE
*
*          FIRST ROTATE NIBBLE AGAIN
*
           RAL
*
*          NOW CHANGE NIBBLE OF SRC ADDRESS
*
           XCH 2
           RAR
           CMC
*
*          CHECK IF NOW 5 IN MS NIBBLE
*
           JCN A TS5
*
*          INCREMENT LS NIBBLE
*
           INC 3
*
*          PUT BACK REG. 2
*
TS5        RAL
           XCH 2
*
*          PUT BACK NIBBLE
*
TS4        XCH 4
*
*          CORRECT FOR DISPLACEMENT IF NECESSARY
*
*          CORRECTION NOT REQUIRED IF MS SRC = 5
*
           LOD 2
           RAR
           JCN 2 TS6
*
*          CORRECTION NOT REQUIRED IF SRC OF LS EVEN
*
           LOD 3
           RAR
           JCN A TS6
*
*          CORRECTION NOT REQUIRED IF NIBBLE PATTERN
*          IS NOT IN MOST SIGNIFICANT PLACE
*
           LOD 4
           RAL
           JCN A TS6
*
*          CORRECT FOR DISPLACEMENT BY GOING
*          TO NEXT ADDRESS
```

```
*
          JUN TS7
*
*         CHECK IF FINISHED (76 IN BCD)  (91 for 90
*                                         number system)
*         FIRST CHECK FOR START SWITCH
*
TS6       LOD 9
          IAC
          JCN 4 TS9
          RAL
          RAL
          JCN 2 TND
*
TS9       LDM 9          (LDM 7 for 90 number system)
          CLC
          ADD E
          JCN C TS1
*
          LDM 9          (LOD F for 90 number system)
          ADD F          (DAC    "   "   "      "    )
          JCN C TS1
*
*         SLOW DOWN INTERRUPT TIMER
*
          FIM 6P D8
*
*         SET SYSTEM TIMER AND WAIT FOR ZERO COUNT
*
          LDM 5
          XCH 6
TS8       LOD 6
          JCN C TS8
*
*         RESET AND BACK TO BEGINNING
*
          FIM OP 40
          JUN TFN
*
*
*         ROUTINE TO SPEED UP TIMER
*
FST       LOD B
          DAC
          JCN 4 REL
          XCH B
          JUN REL
*
*         ROUTINE TO SLOW DOWN TIMER
*
SLW       LOD B
          IAC
          JCN 4 REL
          XCH B
*
*         ROUTINE TO WAIT FOR RELEASE OF
*         CURRENT CONTROL SWITCH
```

```
*
REL       DIN
          LOD 9
          IAC
          EIN
          JCN C REL
          DIN
          JUN COM
*
*
*
*         INTERRUPT EXTENSION. CHECK FOR TOGGLE
*         OFF AND ZERO SYSTEM TIMER. IF TRUE
*         THEN CANCEL DISPLAY
*
*         FIRST CANCEL DISPLAY IF VOID ADDRESS
*
IEX       LOD 2
          RAL
          LDM E
          JCN 2 BSR
          LOD 6
          JCN C IX1
          LOD 8
          RAL
          LDM E
          JCN A BSR
IX1       LDM F
*
*         ROUTINE TO WRITE ACC. TO BIT SET/RESET
*
BSR       SB1
          FIM OP 80
          SRC OP
          SBO
          WRM
          BBL 0
*
*         FINISH OFF TEST ROUTINE
*
TFN       SRC OP
*         LDM 0
          WR1
          JUN TST
*
TND       FIM 1P CO
*
*         JUST PUT IN VOID ADDRESS. NOW RESET TIMER
*
TN1       FIM 6P A5
*
*         RESET 4269 AND LEAVE
*         JUN RST
*
*
```

```
*
*          7 SEGMENT CODE FOR DISPLAY
*
           = 1F6
*
           HEX 3F
           HEX 06
           HEX 5B
           HEX 4F
           HEX 66
           HEX 6D
           HEX 7D
           HEX 07
           HEX 7F
           HEX 6F
*
*
*********************************************
*
*          PAGE 2
*
*
           = 200
*
*          CHECK CONTROL SWITCHES FOR
*          PATTERN GENERATOR
*
*          CHECK FOR PATTERN CONTROL.
*          JUMP TO APPROPRIATE CODE IF CORRECT
*          CHECK. OTHERWISE RETURN TO PAGE 1
*
CSX        LDM 3
           CLC
           ADD A
           JCN 4 SX1
           IAC
           JCN 4 SX4
           IAC
           JCN 4 SX3
           IAC
           JCN 4 SX2
*
XND        BBL 0
*
SX1        LOD 8
           RAR
           JCN A XND
           LOD 7
           RAR
           JCN 2 ROT
           RAR
           JCN A XND
*
*          ROUTINE TO DYNAMICALLY TEST
*          PATTERN BOX
```

```
*
*          FIRST SPEED UP TIMER
*
TPT        FIM 6P F5
           EIN
*
           FIM OP 9C
           JMS TCK
           FIM OP AC
           JMS TCK
           FIM OP A8
           JMS TCK
           JUN TPT
*
*          ROUTINE TO CHECK FOR NEXT PATTERN
*          TRIGGER AND ALSO FOR CANCEL SWITCH
*
TCK        JMS PL1
TK3        LOD 8
           RAL
           JCN 2 TK3
TK1        LOD 8
           RAL
           JCN A TK1
*
*          CHECK FOR CANCEL SWITCH
*
           LOD 9
           IAC
           JCN 4 TK2
           LOD 9
           RAL
           RAL
           JCN A TK2
*
*          SLOW DOWN TIMER AND RESTART
*
           JUN TN1
*
TK2        BBL 0
*
*
*          ROUTINE TO ROTATE PATTERN THROUGH
*          ONE QUADRANT CLOCKWISE (SIX LEFT SHIFTS)
*
ROT        LDM A
           XCH 5
*
*          ROUTINE TO SHIFT PATTERN DISPLAY
*          LEFT ONE POSITION
*
SLF        FIM OP 4F
           SRC OP
           RD3
           RAL
*
```

```
*          GOT INPUT CARRY, NOW SHIFT
*
           FIM OP 5C
*
*          CHECK FOR FINISH
*
SH3        ISZ 1 SH1
           ISZ 5 SLF
           JUN REL
*
*          ROUTINE TO SHIFT OP ADDRESSED PATTERN
*          IN 4269
*
SH1        SRC OP
           RD3
           RAL
           WMP
           LDM 4
           XCH 0
           SRC OP
           RD3
           RAL
           WMP
*
*          SET UP FOR NEXT BLOCK SHIFT
*
           LDM 5
           XCH 0
           JUN SH3
*
*          GET PATTERN ADDRESS DATUM FOR
*          APPROPRIATE CONTROL SWITCH BLOCK POSITION
*
SX2        FIM OP A0
           JUN DPL
SX3        FIM OP C0
           JUN DPL
SX4        FIM OP E0
*
*          ROUTINE TO ADD DISPLACEMENT TO
*          PATTERN ADDRESS
*
DPL        LOD 7
           KBP
           DAC
           CLC
           RAL
           RAL
           XCH 1
           LOD 8
           RAR
           JCN A PL2
           JMS PL1
           JUN COM
PL2        INC 0
*
```

```
*          NOW GET THE FOUR PATTERN BYTES
*
PL1        JMS GET
           LOD E
           FIM 7P 4C
           JMS PUT
           LOD E
           FIM 7P 4D
           JMS PUT
           LOD E
           FIM 7P 4E
           JMS PUT
           LOD E
           FIM 7P 4F
           JUN PUT
*
*          ROUTINES TO PUT AND GET PATTERN BYTES
*
PUT        SRC 7P
           WMP
           INC E
           LOD 5
           SRC 7P
           WMP
*
GET        FIN 7P
           LOD F
           XCH 5
           INC 1
           BBL 0
*
*
*          CENTRE ONLY BYTE PATTERN FOR
*          PATTERN BOX TEST
*
           = 29C
*
           HEX 71
           HEX FF
           HEX FF
           HEX FF
           HEX FF
*
*
           = 2A0
*
*
*          BYTE PATTERNS
*
*          FULL COVER
*
           HEX 71
           HEX 00
           HEX 00
           HEX 00
*
```

```
*
*       INNER COVER
*
        HEX 71
        HEX D7
        HEX 75
        HEX 5D
*
*       OUTER RING
*
        HEX F1
        HEX 28
        HEX 8A
        HEX A2
*
*       INNER RING
*
        HEX F1
        HEX D7
        HEX 75
        HEX 5D
*
*       CROSS
*
        HEX 71
        HEX CF
        HEX F3
        HEX 3C
*
*       DIAGONAL CROSS
*
        HEX 71
        HEX B6
        HEX 6D
        HEX DB
*
*       OUTER LINE
*
        HEX F1
        HEX BC
        HEX FA
        HEX FF
*
*       MIDDLE LINE
*
        HEX F1
        HEX 73
        HEX F5
        HEX FF
*
*       CENTRE LINE
*
        HEX 71
        HEX CF
        HEX FF
        HEX FC
*
```

```
*
*          DIAGONAL
*
           HEX 71
           HEX F6
           HEX 6F
           HEX FF
*
*          K
*
           HEX 71
           HEX BF
           HEX 61
           HEX 3F
*
*          L
*
           HEX F1
           HEX EA
           HEX CF
           HEX A3
*
*          P
*
           HEX 71
           HEX BF
           HEX F2
           HEX 3C
*
*          U
*
           HEX F1
           HEX 2A
           HEX 8F
           HEX A2
*
*          V
*
           HEX 71
           HEX B6
           HEX FD
           HEX FF
*
*
$
```

The embodiments of the invention in which an exclusive property or privelege is claimed are defined as follows:

1. In an electronic bingo game, a system for illuminating selected one or more of a plurality of lamps in an illuminated bingo display located at a remote location to indicate one or more selected bingo numbers comprising:

(a) a microcomputer system, including data and program memories connected to a central processing unit, adapted to store and process signals representative of a selected external crosspoint and signals representative of a signal processing sequence, and to derive the store signals representative of one or more of said lamps to be illuminated, as a result of translation of the processing sequence signals, (b) means connected to and controlled by the microcomputer system for scanning an array of external crosspoints and for translating the closing of said selected crosspoint to a location signal representative of the location of said crosspoint in said array, and including storing means for storing the location signal, (c) converter means connected to the storing means for translating the location signal into a serial bit stream signal representative of the address of one or more particular lamps to be illuminated, and (d) a display bus connected to the output of the converter means for carrying the serial bit stream signal, for connection to a serial bit stream signal decoding and lamp illumination circuit.

2. In an electronic bingo game as defined in claim 1, further including means connected to the microcomputer system for decoding and locally displaying the location signal as at least one numeral designative of the lamp to be illuminated.

3. In an electronic bingo game as defined in claim 2, further including a display board carrying a plurality of lamps to be illuminated, a plurality of light drivers connected to the lamps for individual operation thereof, means connected to the display bus for decoding the serial bit stream signal, deriving an address and enabling the light drivers to cause illumination of said lamps.

4. In an electronic bingo game as defined in claim 2, further including means for selectively adding the location signal of a selected lamp to be illuminated to said bit stream only after local display of the corresponding said numeral.

5. In an electronic bingo game as defined in claims 2 or 4, and also including means for causing said selected lamp to flash separately on and off only until a further lamp is selected and its corresponding location signal added into said bit stream, which further lamp is caused to flash repeatedly on and off, and the earlier said selected lamp is caused to be steadily illuminated.

6. In an electronic bingo game as defined in claim 2, in which the scanning means is comprised of a plurality of scanning signal output terminals and an equal plurality of scanned signal input terminals; a plurality of row and column terminals for respective connection to each row and column of said array of crosspoint switches, each row terminal for connection in common to one contact of each crosspoint switch in a corresponding row and each terminal for connection in common to an opposing contact of each crosspoint switch in a corresponding column, the numbers of column terminals being greater than the number of scanned signal input terminals; the row terminals being connected to individual ones of the scanning signal output terminals, a portion of the column terminals being connected to individual ones of the scanned signal input terminals and the remaining ones of the column terminals being connected in parallel with said portion of the column terminals to the individual ones of the scanned signal input terminals, and further including means for sequentially and repeatedly enabling said portion and then said remaining ones of the column terminals for passing said scanning signal should it appear due to closure of a crosspoint switch.

7. In an electronic bingo game as defined in claim 6 in which the means for enabling is comprised of individual gate means, said portion column terminals being individually connected to the inputs of corresponding ones of said gates, the outputs of which are individually connected to corresponding ones of said scanned signal input terminals, said remaining column terminals being individually connected to the inputs of corresponding others of said gates, the outputs of which are individually connected in parallel with said corresponding ones of said gates to individual ones of said scanned signal input terminals, further including means for simultaneously enabling all of only said one gates during one scanning cycle and simultaneously enabling all of only said others of said gates during a following scanning cycle by said scanning means.

8. In an electronic bingo game as defined in claim 7, further including a display board carrying a plurality of lamps to be illuminated, a plurality of light drivers connected to the lamps for individual operation thereof, means connected to the display bus for decoding the serial bit stream signal, deriving an address and enabling the light drivers to cause illumination of said lamps.

9. In an electronic bingo game as defined in claim 8, further including means for causing the latest selected one of said selected lamps to flash separately on and off until a further lamp is selected and its corresponding location signal added into said bit stream, which further lamp is caused to flash repeatedly on and off and the previously flashing lamp is caused to be steadily illuminated.

10. In an electronic bingo game as defined in claims 2, 6 or 9 in which the array of crosspoints is formed at the intersections of a plurality of parallel rows and orthogonally parallel columns of strip conductors, terminated by a row of terminals each connected to a row conductor and a column of terminals each connected to a column conductor, a particular crosspoint being closed upon the selective contacting of a particular row and a particular column conductor.

11. In an electronic bingo game as defined in claims 3, 8 or 9 further including optical isolator means interconnecting individual leads of the display bus to the means for decoding the serial bit stream signal.

12. In an electronic bingo game as defined in claim 8 in which the microcomputer includes means for the generating of lamp address signals of the form to cause all of said lamps to flash repeatedly upon operation of an external switch by an operator, while retaining storage of signals designative of the locations of previously illuminated lamps, and for causing the cessation of said flashing and generation of lamp address signals for reillumination of said previously illuminated lamps upon operation of another external switch by the operator.

13. In an electronic bingo game as defined in claim 12 in which the microcomputer includes means for generating lamp address signals for causing preselected ones of said lamps to turn on and off in a predetermined pattern on the display board upon operation of an external switch by the operator.

14. In an electronic Bingo game, the combination comprising a ball, table including a matrix of numbered switches for closure upon interference by a numbered ball, a plurality of control switches, a general display for individually illuminating one or more numbers corresponding to each numbered switch of the matrix of switches, means at the table for causing a digital display to indicate the number of the numbered switch upon at least temporary closure of one of said numbered switches, and means for illuminating the corresponding number in the general display upon at least temporary closure of a predetermined one of the control switches.

15. In an electronic Bingo game, the combination as defined in claim 14 further comprising means for causing flashing of the latest illuminated number of the general display while rendering the remaining previously flashing numbers continuously illuminated.

16. In an electronic Bingo game, the combination as defined in claim 14 or 15, further comprising means for causing flashing of the digital display a predetermined period after its initial display, and cessation of flashing once a new number has been indicated.

17. In an electronic Bingo game, the combination as defined in claim 14 including means, upon at least temporary closing of a predetermined control switch, for causing illumination of all numbers in sequence.

18. In an electronic Bingo game, the combination as defined in claim 17, in which said sequence follows a predetermined pattern, and further including means for extinguishing said pattern and re-establishing the previously displayed pattern on the general display upon at least temporary closure of a further predetermined control switch.

19. A system for illuminating selected one or more of a plurality of lamps in a display located at a remote location comprising:

(a) a microcomputer system, including data and program memories connected to a central processing unit, adapted to store and process signals representative of a selected external crosspoint and signals representative of a signal processing sequence, and to derive and store signals representative of one or more of said lamps to be illuminated, as a result of translation of the processing sequence signals, (b) means connected to and controlled by the microcomputer system for scanning an array of external crosspoints and for translating the closing of said selected crosspoint to a location signal representative of the location of said crosspoint in said array, and including storing means for storing the location signal, (c) converter means connected to the storing means for translating the location signal into a serial bit stream signal representative of the address of one or more particular lamps to be illuminated, and (d) a display bus connected to the output of the converter means for carrying the serial bit stream signal, for connection to a serial bit stream signal decoding and lamp illumination circuit.

20. A system for illuminating selected one or more of a plurality of lamps in a display located at a remote location comprising:

(a) a microcomputer system, including data and program memories connected to a central processing unit, adapted to generate a random number signal and to store and process signals representative of the generated random number signal as well as signals representative of a signal processing sequence, and to derive and store signals representative of one or more of said lamps to be illuminated, as a result of translation of the processing sequence signals, (b) converter means connected to the storing means for translating the random number signal into a serial bit stream signal representative of the address of one or more particular lamps to be illuminated, and (c) a display bus connected to the output of the converter means for carrying the serial bit stream signal, for connection to a serial bit stream signal decoding and lamp illumination circuit.

21. In an electronic bingo game, a system for illuminating selected one or more of a plurality of lamps in an illuminated bingo display located at a remote location to indicate one or more selected bingo numbers comprising:

(a) a microcomputer system, including data and program memories connected to a central processing unit, adapted to generate a random number signal and to store and process signals representative of the generated random number signal as well as signals representative of a signal processing sequence, and to derive and store signals representative of one or more of said lamps to be illuminated, as a result of translation of the processing sequence signals, (b) converter means connected to the storing means for translating the random number signal into a serial bit stream signal representative of the address of one or more particular lamps to be illuminated, and (c) a display bus connected to the output of the converter means for carrying the serial bit stream signal, for connection to a serial bit stream signal decoding and lamp illumination circuit.

22. In an electronic Bingo system as defined in claim 21, the random number generator including a modulo 16 counter, in which the digit in the 14th and 15th positions are added into the 16th position as the counter shifts data sequentially therethrough.

* * * * *